US011344128B2

(12) United States Patent
Chen et al.

(10) Patent No.: US 11,344,128 B2
(45) Date of Patent: May 31, 2022

(54) HEIGHT ADJUSTMENT ASSEMBLY

(71) Applicant: ATEC INTERNATIONAL TEAM CO., LTD., Luzhu Township, Taoyuan County (TW)

(72) Inventors: Te-Chun Chen, Luzhu Township, Taoyuan County (TW); Fu-Ming Chen, Luzhu Township, Taoyuan County (TW)

(73) Assignee: ATEC INTERNATIONAL TEAM CO., LTD., Taoyuan (TW)

( * ) Notice: Subject to any disclaimer, the term of this patent is extended or adjusted under 35 U.S.C. 154(b) by 0 days.

(21) Appl. No.: 17/149,359

(22) Filed: Jan. 14, 2021

(65) Prior Publication Data

US 2022/0007841 A1 Jan. 13, 2022

(30) Foreign Application Priority Data

Jul. 8, 2020 (TW) ..... 109123052

(51) Int. Cl.
*A47C 7/54* (2006.01)

(52) U.S. Cl.
CPC ..... *A47C 7/541* (2018.08)

(58) Field of Classification Search
CPC ..... A47C 1/03; A47C 1/0303; A47C 7/402; A47C 7/541; B60N 2/77
USPC ..... 297/411.36
See application file for complete search history.

(56) References Cited

U.S. PATENT DOCUMENTS

| | | | | |
|---|---|---|---|---|
| 6,688,698 | B1 * | 2/2004 | Chou | A47C 1/03 297/411.36 |
| 9,248,764 | B2 * | 2/2016 | Park | B60N 2/38 |
| 2011/0084535 | A1 * | 4/2011 | Diffrient | A47C 1/03 297/411.36 |
| 2012/0175933 | A1 * | 7/2012 | Tsai | B60N 2/77 297/411.36 |

* cited by examiner

*Primary Examiner* — Sarah B McPartlin
(74) *Attorney, Agent, or Firm* — Muncy, Geissler, Olds & Lowe, P.C.

(57) ABSTRACT

A height adjustment assembly for use in furniture such as a chair armrest is revealed. The height adjustment assembly includes a fixing base, an outer sleeve, and a rod. A snap block is released from one of one of the slots of the fixing base to be in a released state when a drive portion of the rid is driven for synchronously driving the snap block of the rod to move for adjustment. Now the fixing base remains still and the outer sleeve can be moved and adjusted vertically relative to the fixing base. The vertical movement of the outer sleeve includes a highest point and a lowest point. The fixing base or a fixed position of the fixing base is located between the highest point and the lowest point. Thereby the fixing base is covered with the outer sleeve to improve beauty and quality of the furniture.

10 Claims, 24 Drawing Sheets

HEIGHT ADJUSTMENT ASSEMBLY

BACKGROUND OF THE INVENTION

The present invention relates to a height adjustment assembly, especially to a height adjustment assembly used in home furniture or office furniture such as a chair armrest for covering internal components and further improving the sense of beauty and the sense of quality.

Refer to FIG. 25, a height adjustment mechanism 1*a* for use in home furniture or office furniture available now is revealed. A chair armrest is taken as an example. The height adjustment mechanism 1*a* generally includes a sliding base 10*a*, an outer sleeve 20*a* and a fixing member 30*a*. The sliding base 10*a* is fixed on the fixing member 30*a* while the outer sleeve 20 is disposed around the sliding base 10*a* and able to slide vertically. The fixing member 30*a* is arranged at the left side or the right side of a seat 4*b* of a chair 4 (a kind of the furniture or office furniture). In order to adjust the height of the outer sleeve 20*a* (also the height of a chair armrest 2), the sliding base 10*a* and the fixing member 30*a* remain still while the outer sleeve 20*a* is vertically moved and adjusted relative to the sliding base 10*a* and the fixing member 30*a*. Thus an object such as the chair armrest 2 or a tablet disposed on the outer sleeve 20*a* can be moved and adjusted vertically along with the outer sleeve 20*a*.

However, the appearance of the height adjustment mechanism 1*a* is obviously a two-segmented structure formed by one outer sleeve 20*a* and one fixing member 30*a* and the fixing member 30*a* is exposed and visible to users viewing from the left side or the right side of the chair 4 (the home furniture or office furniture mentioned above). Thereby the aesthetic feel and the value of the chair are influenced and damaged. Even consumer's intention to purchase the furniture is affected.

SUMMARY OF THE INVENTION

Therefore it is a primary object of the present invention to provide a height adjustment assembly for use in home furniture or office furniture such as a chair armrest. An outer sleeve is moved and adjusted vertically relative to a fixing base when users drive a drive portion for synchronously driving a snap block of a rod to move and adjust. When the outer sleeve is moved and adjusted vertically with respect to the fixing base, the vertical movement of the outer sleeve includes a highest point and a lowest point. Now the fixing base or the place where the fixing base is fixed is located within the height range from the highest point to the lowest point of the vertical movement of the outer sleeve. Thereby the fixing base or the position where the fixing base is fixed is covered with the outer sleeve to improve the beauty of the chair and the sense of quality the chair has.

In order to achieve the above object, a height adjustment assembly according to the present invention includes a fixing base, an outer sleeve, and a rod. The fixing base consists of a slot portion, a rail portion and a fixing portion. The slot portion includes a plurality of slots which are spaced apart, arranged vertically and communicating with one another. The fixing portion is for being mounted to and fixed on a fixed position on one side of home furniture or office furniture. The outer sleeve is connected to and located outside the fixing base, able to be sliding vertically along the rail portion. The outer sleeve is composed of a mounting seat, an operation window, and a sliding base. The mounting seat is disposed on top of the outer sleeve while the operation window is arranged at one side of the outer sleeve and communicating with an inner space of the outer sleeve. The sliding base is mounted in the inner space of the outer sleeve. The rod is mounted in the sliding base of the outer sleeve, able to be sliding vertically and composed of a drive portion, an elastic member seat and a snap block. The drive portion is extending from the top of the rod and protruding from the operation window of the outer sleeve for allowing users to operate the height adjustment assembly. An elastic member is mounted in the elastic member seat. The snap block can be mounted and locked into one of the slots of the slot portion of the fixing base by elasticity of the elastic member of the rod. Thereby the mounting seat of the outer sleeve is positioned at a certain height corresponding to the slot in which the snap block is locked. The snap block is released from one of the slots of the slot portion of the fixing base to be in a released state when the user drives the drive portion in order to drive the snap block of the rod to move for adjustment synchronously. At the moment, the fixing base remains still while the outer sleeve and the rod can be moved and adjusted vertically relative to the fixing base. After vertical movement and adjustment of the outer sleeve and the rod, the user releases the drive portion. Then the snap block is mounted and locked into another one of the slots of the slot portion of the fixing base by elasticity of the elastic member, back to the fastened state. The vertical movement of the outer sleeve includes a highest point and a lowest point when the outer sleeve is moved and adjusted vertically relative to the fixing base. At the moment, the fixing base or the place where the fixing base is fixed is located within the height range from the highest point to the lowest point. Thereby the fixing base is covered with the outer sleeve so that both the beauty and the value of the furniture are improved.

Preferably, two inclined guiding slots are arranged at two opposite sides of a lower end of the rod and corresponding to each other. The inclined guiding slot is extending outward and downward obliquely. Two sliding wings are projecting from the left side and the right side of the snap block respectively. The two sliding wings are limited within and moved along the two inclined guiding slots of the rod. Thereby the vertical movement of the rod can be converted into the horizontal movement of the snap block.

Preferably, the rod is further provided with a pad which is used for covering the elastic member seat and located between the sliding base and the slot portion. The pad includes a guiding hole through which the snap block is inserted. The snap block is limited in the guiding hole and moved horizontally when the vertical movement of the rod is converted into the horizontal movement of the snap block.

Preferably, the elastic member is a spring. The sliding base is provided with an upper spring assembly portion and the elastic member seat is provided with a lower spring assembly portion which is aligned with the upper spring assembly portion. The elastic member is arranged between the upper spring assembly portion and the lower spring assembly portion.

Preferably, the outer sleeve further includes a cover member which is disposed on one side of the outer sleeve for covering the rod. The cover member is one part formed by a first cover plate and a second cover plate secured with each other firmly. The first cover plate is covering the rod and provided with a first long slot with an opening facing downward while the second cover plate is arranged over the first cover plate and having a second long slot with an opening facing downward. The first long slot and the second long slot are aligned with each other. The first long slot and the second long slot of the of the cover member are connected to the rail portion and able to slide vertically along the rail portion.

Preferably, the drive portion is located on top of the rod while the inner space of the top of the outer sleeve further includes a sliding space which is located adjacent to the operation window. The drive portion is moved into the sliding space when users drive the drive portion for synchronously driving the snap block of the rod to move for adjustment.

Preferably, a plurality of anti-vibration members are disposed on an outer edge of the fixing base for abutting against both the fixing base and the sliding base.

Preferably, the drive portion of the rod is detachably mounted to the rod.

Preferably, the fixing portion of the fixing base is a long and narrow locking block. The home furniture or office furniture is a chair which includes a seat back and a seat. The height adjustment assembly is further connected to one side of the seat back of the chair by the fixing portion being inclined an angle.

Preferably, the mounting seat of the outer sleeve is used for connection to an armrest or a tablet.

DETAILED DESCRIPTION OF THE PREFERRED EMBODIMENTS

Figure 3:
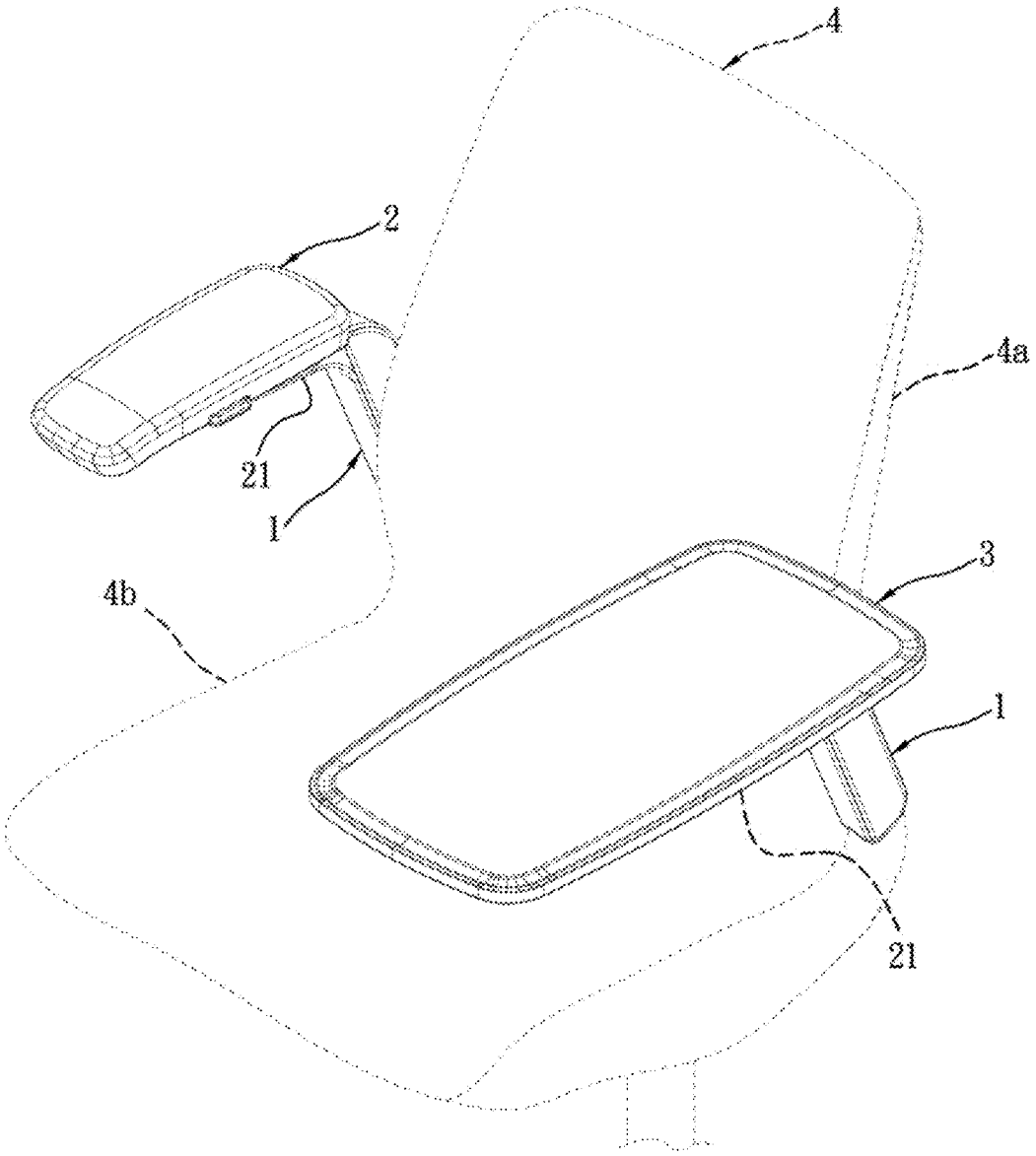
FIG. 3 is a schematic drawing showing an embodiment for use in a chair and connected to an armrest and a tablet according to the present invention.
Figure 4:
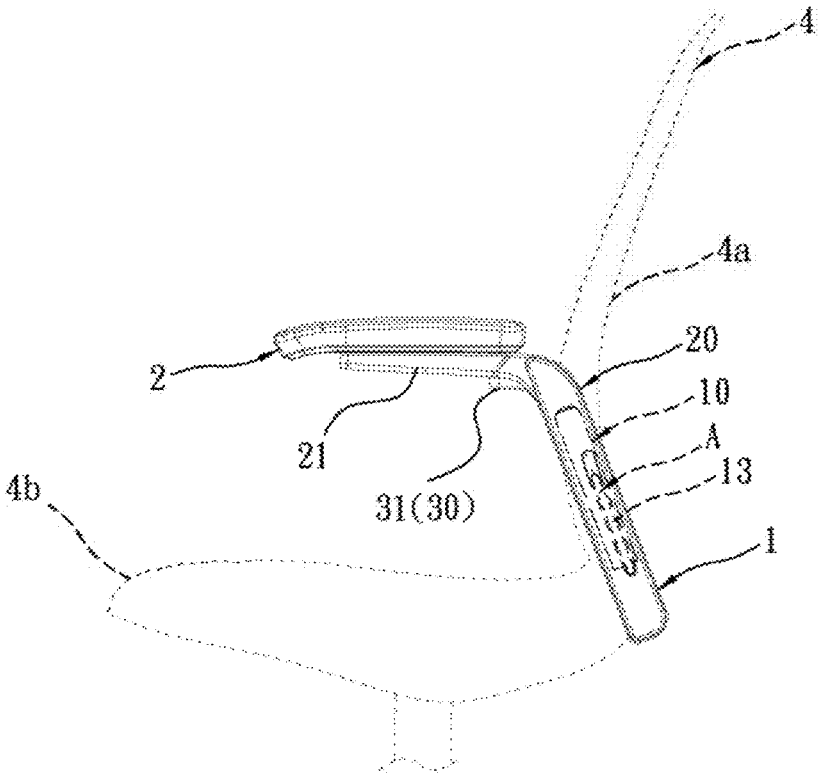
FIG. 4 is a schematic view showing a side view of an embodiment used in a chair according to the present invention.
Figure 5:
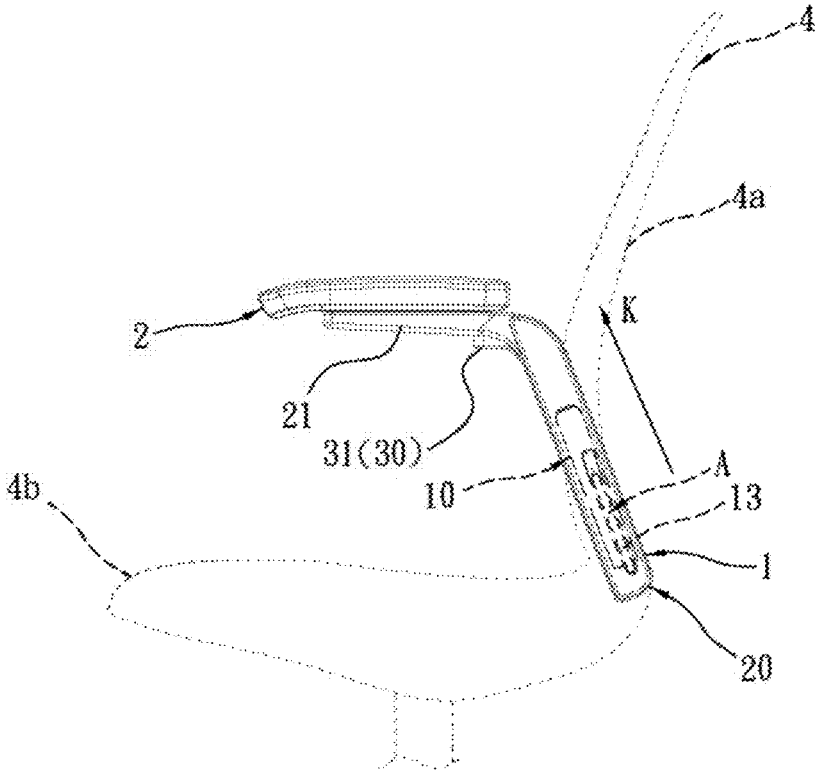
FIG. 5 is a schematic view showing an outer sleeve of the embodiment in FIG. 4 being moved upward according to the present invention.

A height adjustment assembly according to the present invention is for use in home furniture or office furniture such as chair. The directions such as the left, the right, etc. mentioned in the following descriptions are from users' point of view. As shown in FIG. 3-5, the above home furniture or office furniture can be but not limited to an office chair 4 which includes a seat back 4*a* and a seat 4*b*.

In a preferred embodiment, a height adjustment assembly 1 is used in combination with the chair 4 by being assembled on one side of the seat back 4*a*, as shown in FIG. 3-5. While a user sits on the seat 4*b* of the chair 4, he/she can operate the height adjustment assemblies 1 on the right side and the left side easily for adjusting of the height. The height adjustment assembly 1 includes a fixing base 10, an outer sleeve 20 and a rod 30.

Figure 6:
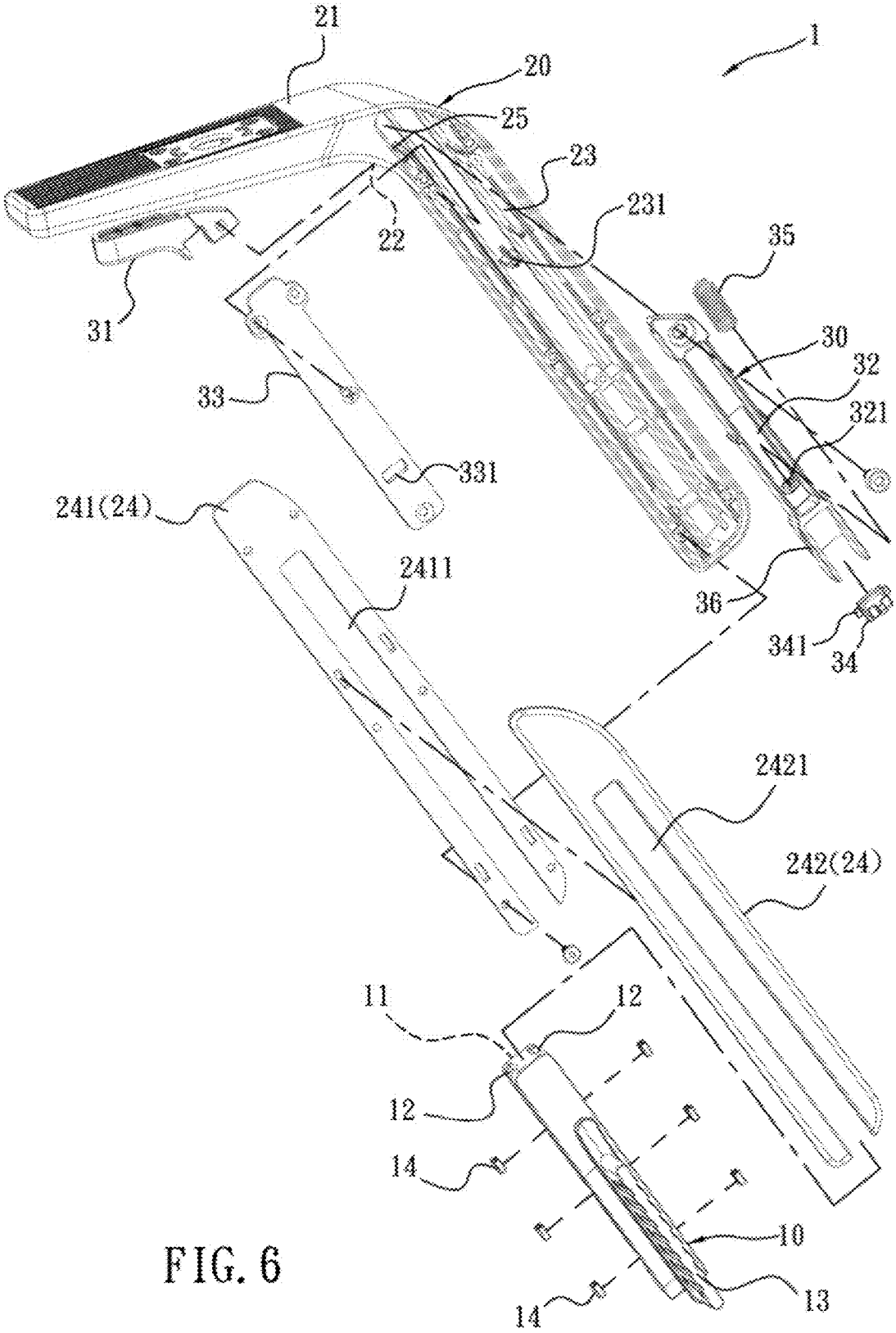
FIG. 6 is an explosive view of an embodiment according to the present invention.
Figure 7:
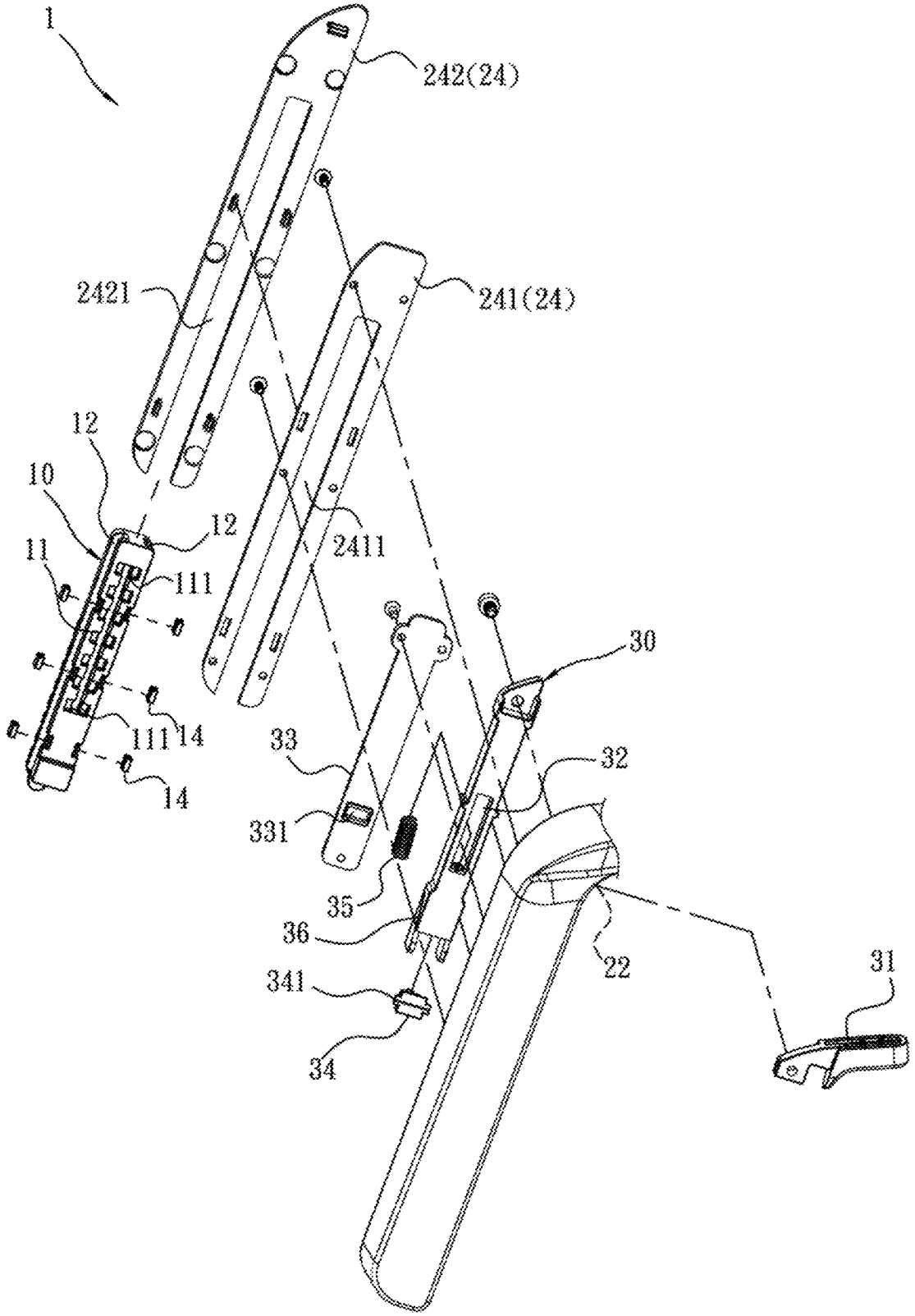
FIG. 7 is another explosive view of an embodiment viewed from another angle according to the present invention.
Figure 14:
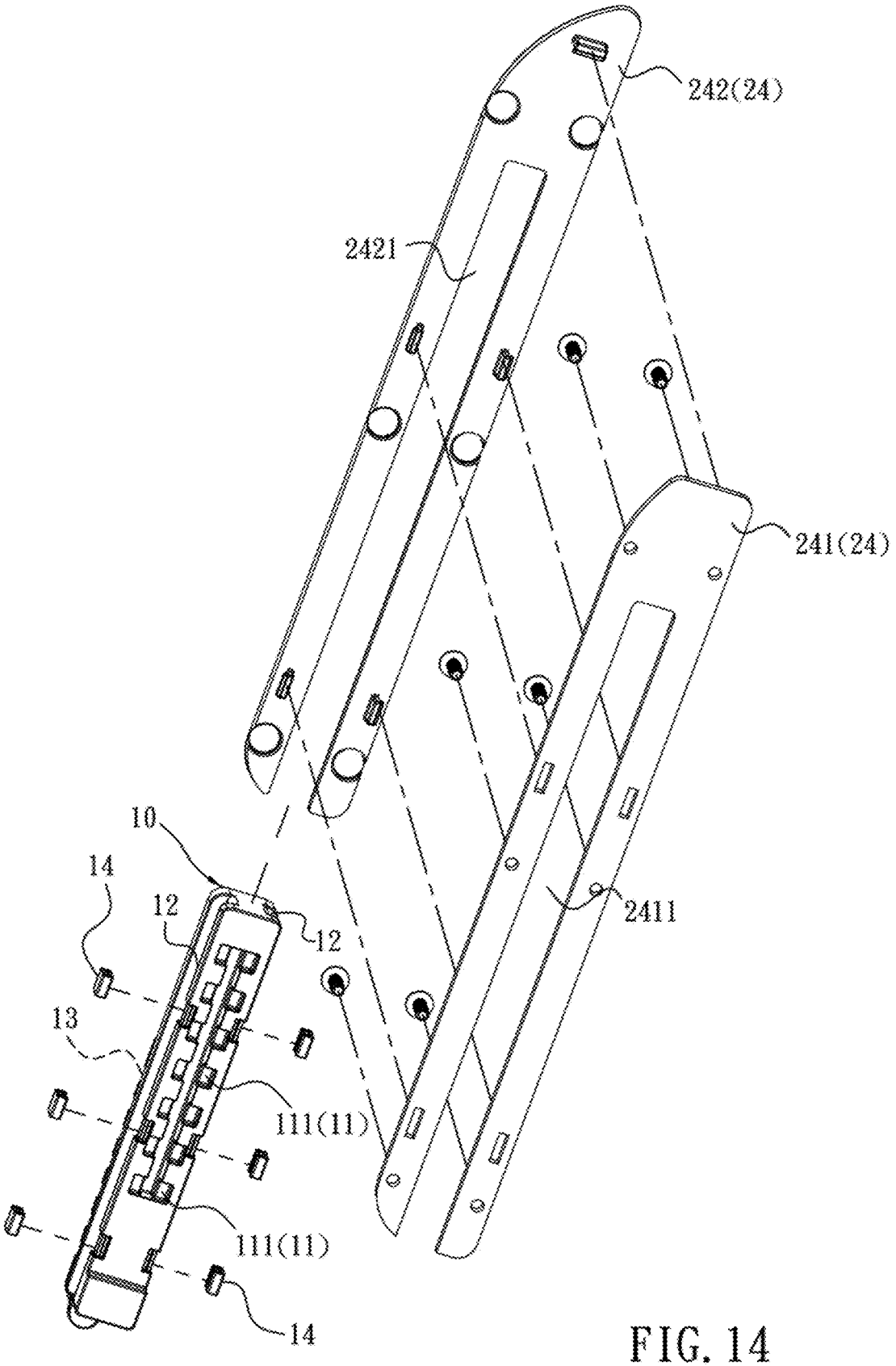
FIG. 14 is an explosive view of a fixing base connected to a cover member of an embodiment viewed from an angle according to the present invention.
Figure 16:
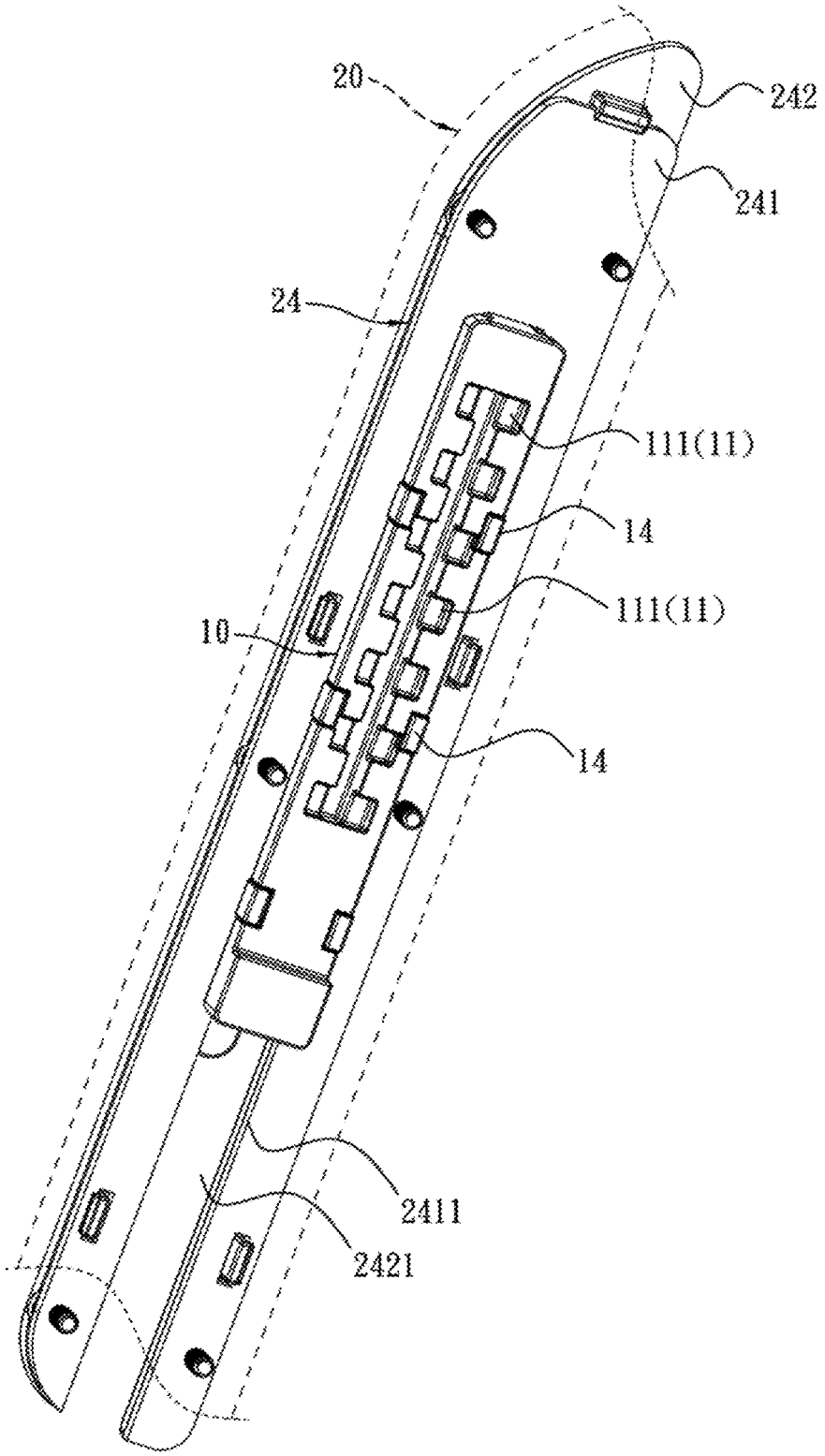
FIG. 16 is a perspective view of an embodiment in which a fixing base and cover member are connected to an outer sleeve according to the present invention.

Refer to FIG. 6 and FIG. 7, the fixing base 10 consists of a slot portion 11, a rail portion 12, and a fixing portion 13. The slot portion 11 includes a plurality of slots 111 which are spaced apart, arranged vertically and communicating with one another, as shown in FIG. 14 and FIG. 16. In this embodiment, the fixing portion 13 is a locking block which is long and narrow and used for being mounted in and fixed on a fixed position A on one side of the seat back 4*a* of the chair 4, as shown in FIG. 4 and FIG. 5. The fixing portion 13 is completely mounted and hidden in the fixing position A, without being exposed.

The height adjustment assembly 1 is further connected to one side of the seat back 4*a* of the chair 4 by the fixing portion being inclined a certain angle, as shown in FIG. 3-5 for use in combination with the curved line of the seat back 4*a* to show aesthetic design and the sense of value of the chair 4.

Figure 1:
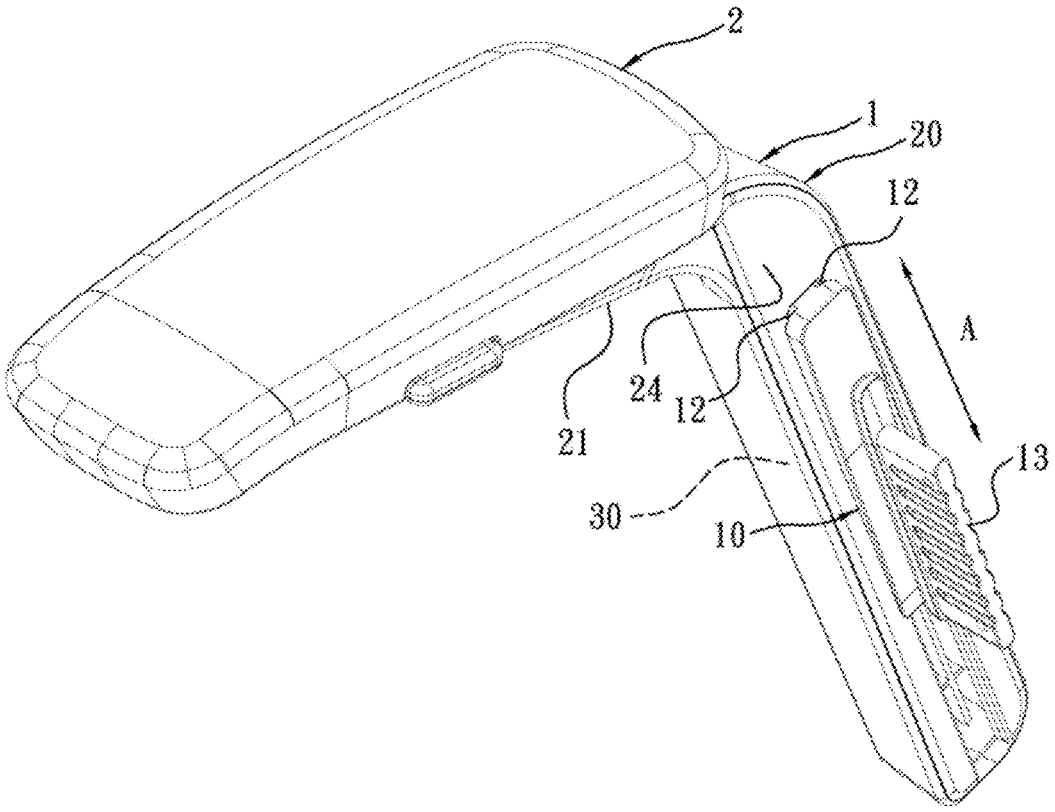
FIG. 1 is a perspective view of an embodiment according to the present invention.
Figure 2:
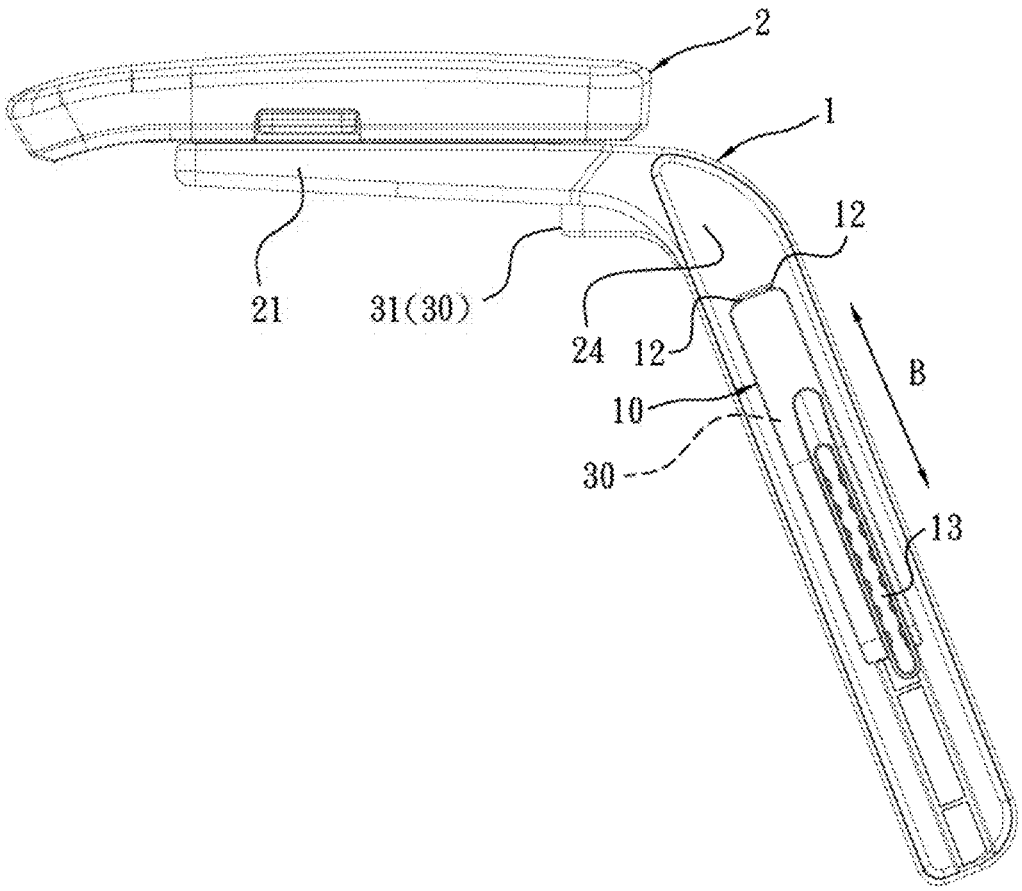
FIG. 2 is a schematic drawing showing a side view of the embodiment in FIG. 1 according to the present invention.
Figure 9:
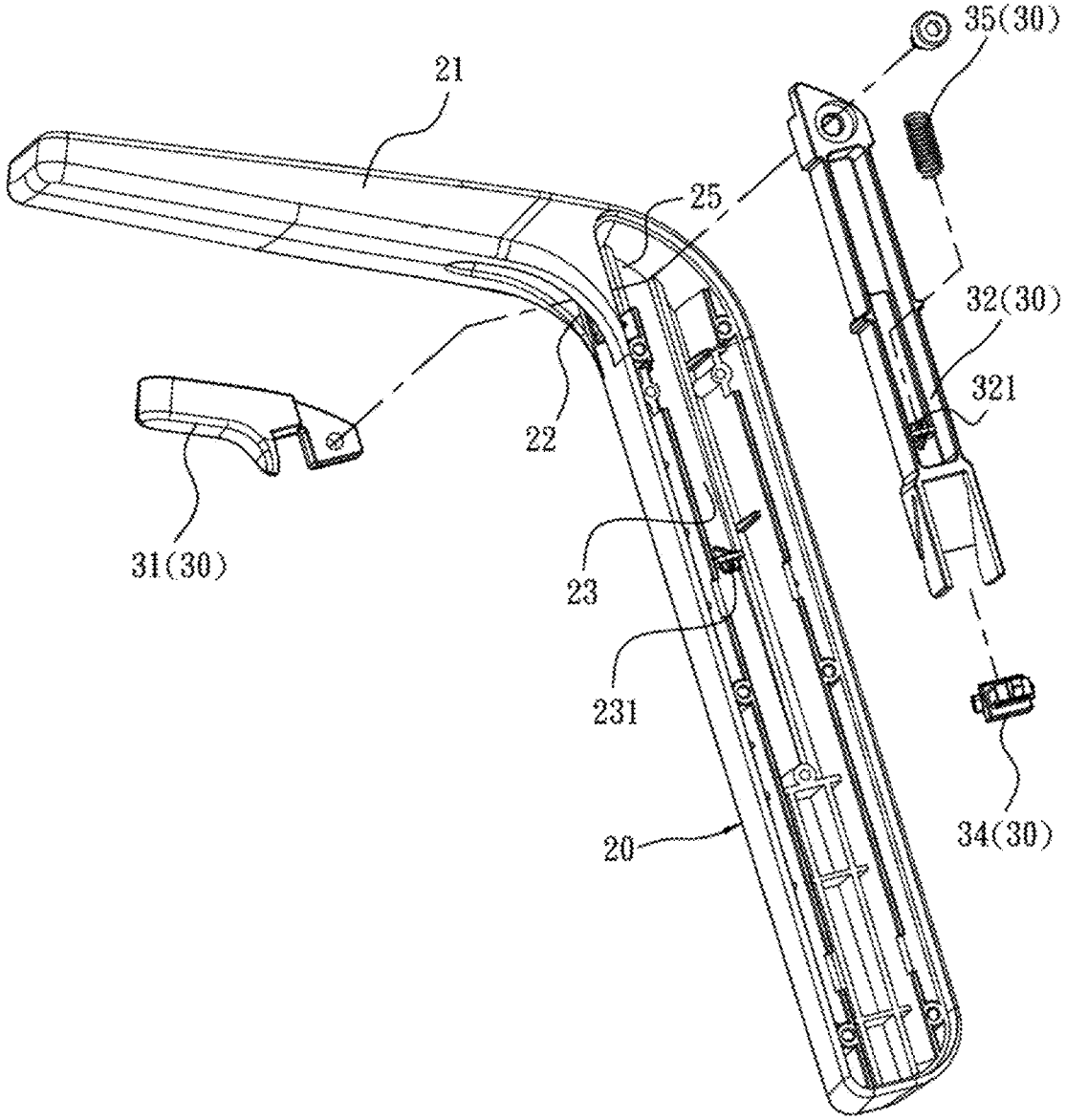
FIG. 9 is a schematic drawing showing an explosive view of an embodiment in which a rod is connected to an outer sleeve according to the present invention.
Figure 10:
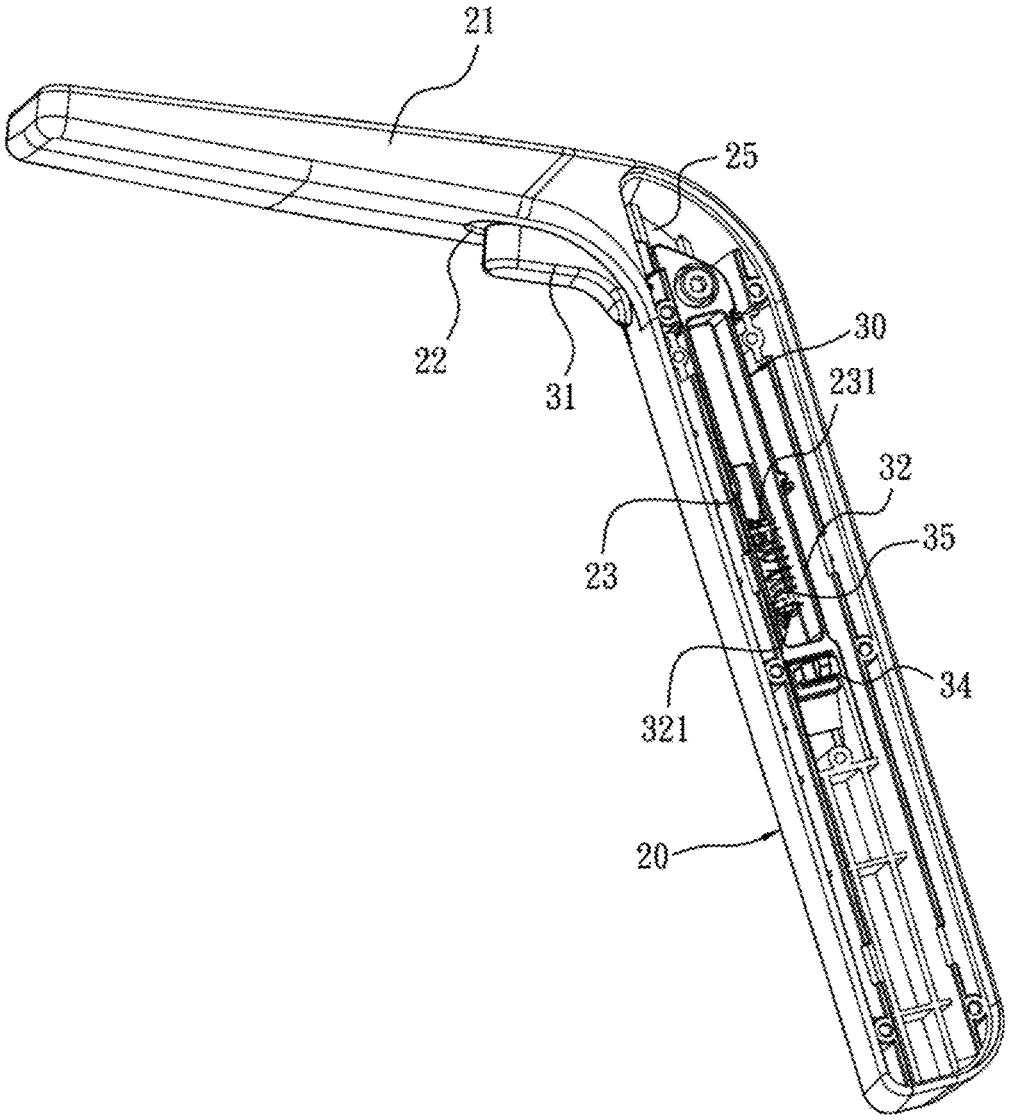
FIG. 10 is a perspective view of the embodiment in FIG. 9 according to the present invention.
Figure 11:
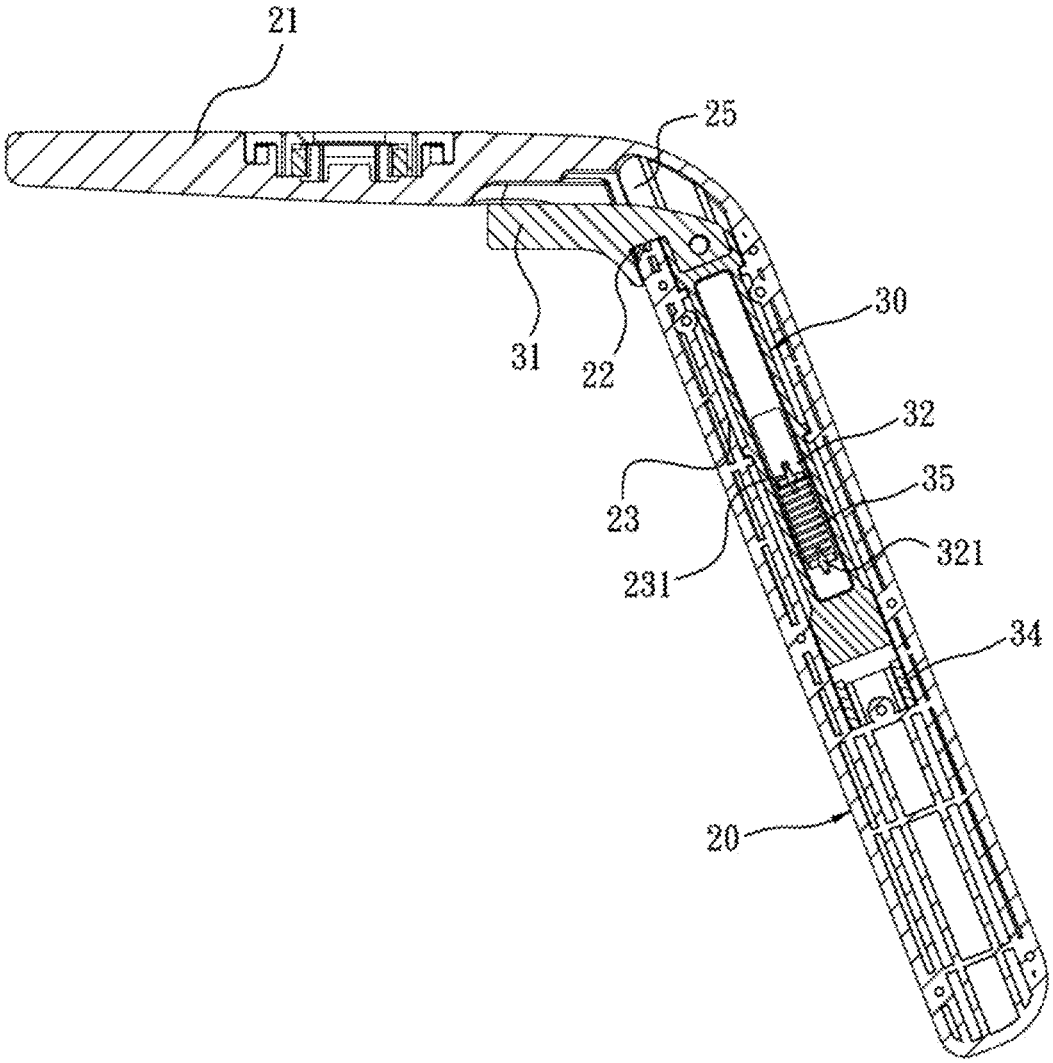
FIG. 11 is a side view of a section of the embodiment in FIG. 10 according to the present invention.
Figure 12:
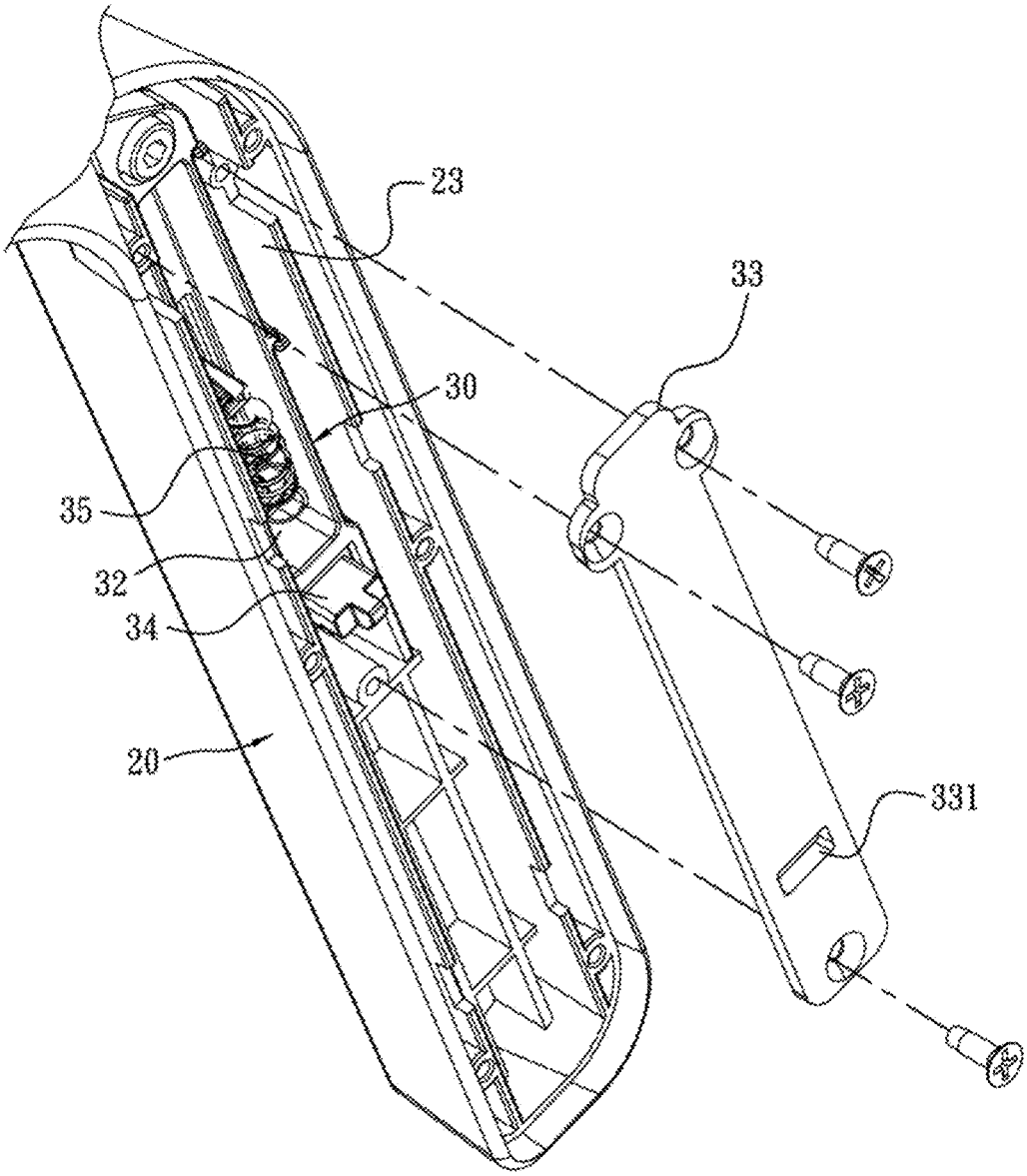
FIG. 12 is a partial enlarged explosive view of a pad assembled with a rod of an embodiment according to the present invention.
Figure 13:
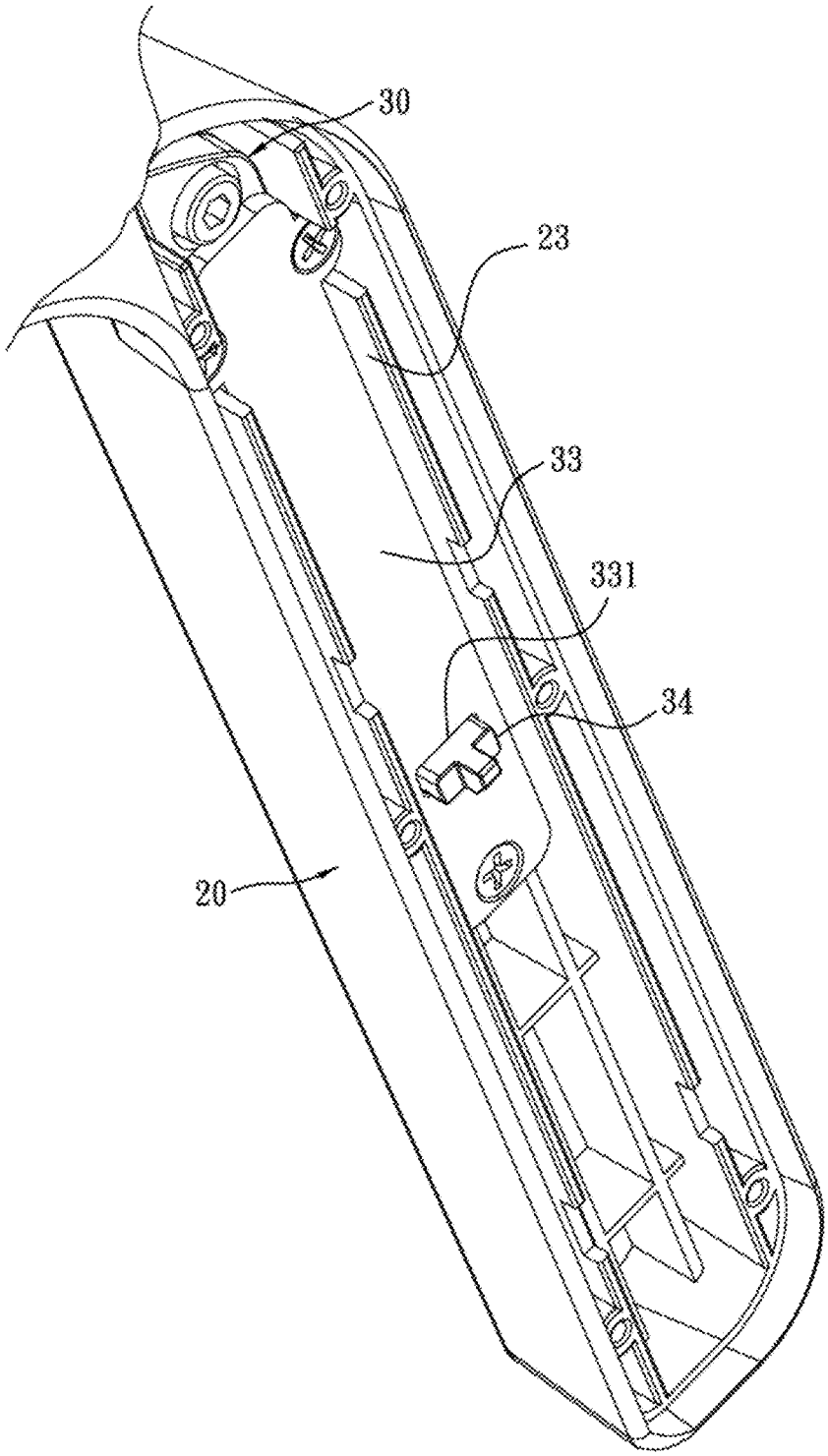
FIG. 13 is a perspective view of the embodiment in FIG. 12 according to the present invention.
Figure 15:
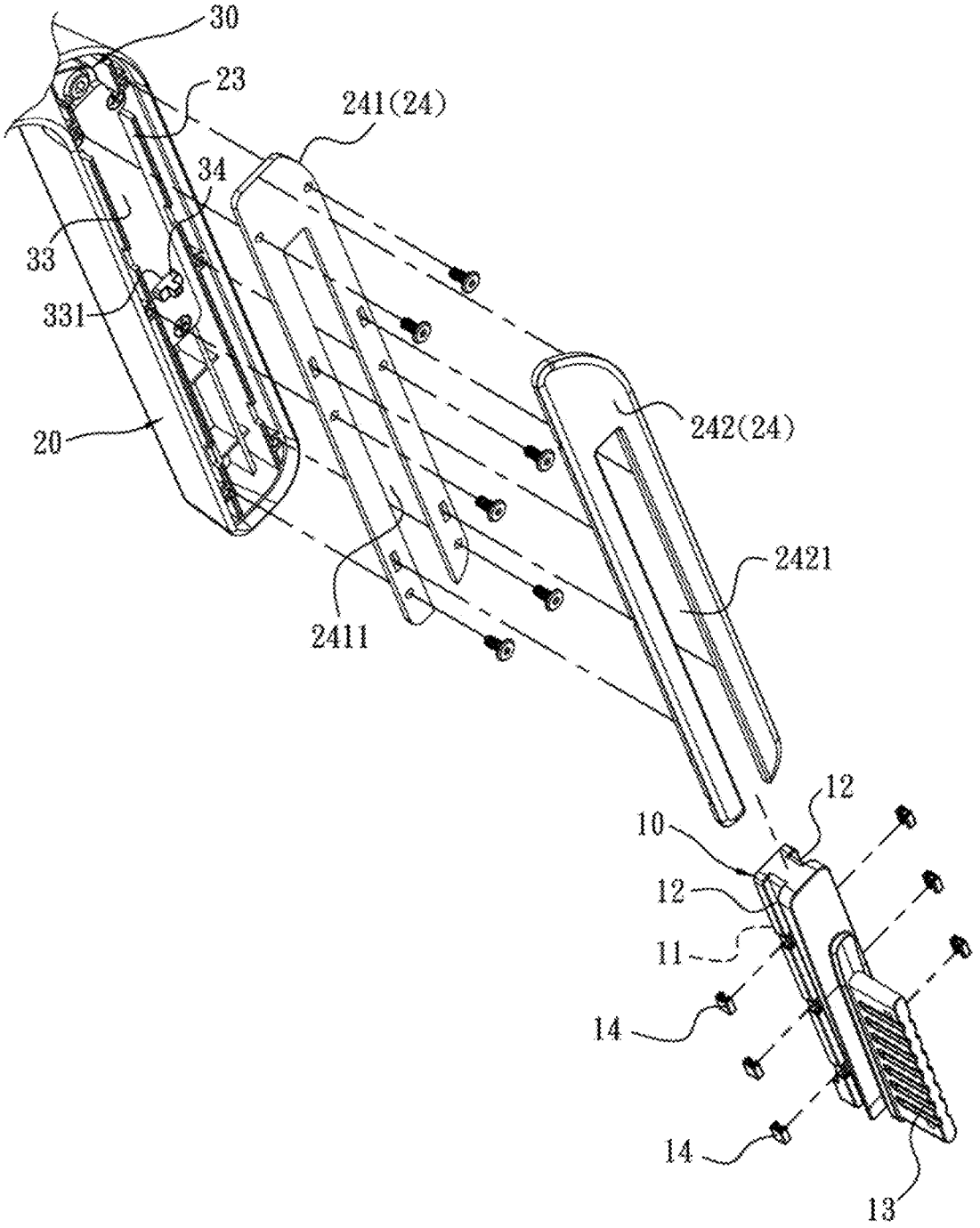
FIG. 15 is an explosive view of both a fixing base and a cover member being connected to an outer sleeve of an embodiment according to the present invention.

The outer sleeve 20 is connected to and located outside the fixing base 10, able to be moved vertically along the rail portion 12, as the arrow A in FIG. 1 and the arrow B in FIG. 2 indicate. The outer sleeve 20 is composed of a mounting seat 21, an operation window 22, a sliding base 23, a cover member 24 and a sliding space 25, as shown in FIG. 6 and FIG. 7. The mounting seat 21 is located on top of the outer sleeve 20 and used for connection to an armrest 2 or a tablet 3, as shown n FIG. 1-3. The operation window 22 is disposed on one side of the outer sleeve 20 and communicating with an inner space of the outer sleeve 20, as shown in FIG. 6, FIG. 7, and FIG. 9-11. The sliding base 23 is mounted in the inner space of the outer sleeve 20 and provided with an upper spring assembly portion 231, as shown in FIG. 9-11. As to the cover member 24, it is mounted on one side of the outer sleeve 20 for covering the rod 30, as shown in FIG. 6, FIG. 7, and FIG. 15. The sliding space 25 is located in the inner space of the top of the outer sleeve 20 and adjacent to the operation window 22, as shown in FIG. 9-11.

The cover member 24 is one part formed by a first cover plate 241 and a second cover plate 242 secured with each other firmly. The first cover plate 241 is fastened on the sliding base 23 by screws and covering the rod 30 to prevent the structure related to the rod 30 from being exposed. The first cover plate 241 is provided with a first long slot 2411 with an opening facing downward. By hooks, the second cover plate 242 is locked on and arranged over the first cover plate 241 to cover both screws on the first cover plate 241 and the structure related to the sliding base 23 for compact design and aesthetic purpose. The second cover plate 242 has a second long slot 2421 with an opening facing downward. The first long slot 2411 and the second long slot 2421 are aligned with each other, connected to the rail portion 12, and able to slide vertically along the rail portion 12, as shown in FIG. 6, FIG. 7 and FIG. 14-16.

Moreover, a plurality of anti-vibration members 14 are disposed on an outer edge of the fixing base 10 for abutting against both the fixing base 10 and the sliding base 23, as shown in FIG. 6, FIG. 7, and FIG. 15 to maintain stability of the outer sleeve 20 while the outer sleeve 20 is sliding vertically. The anti-vibration members 14 are used for damping of the outer sleeve 20.

Figure 8:
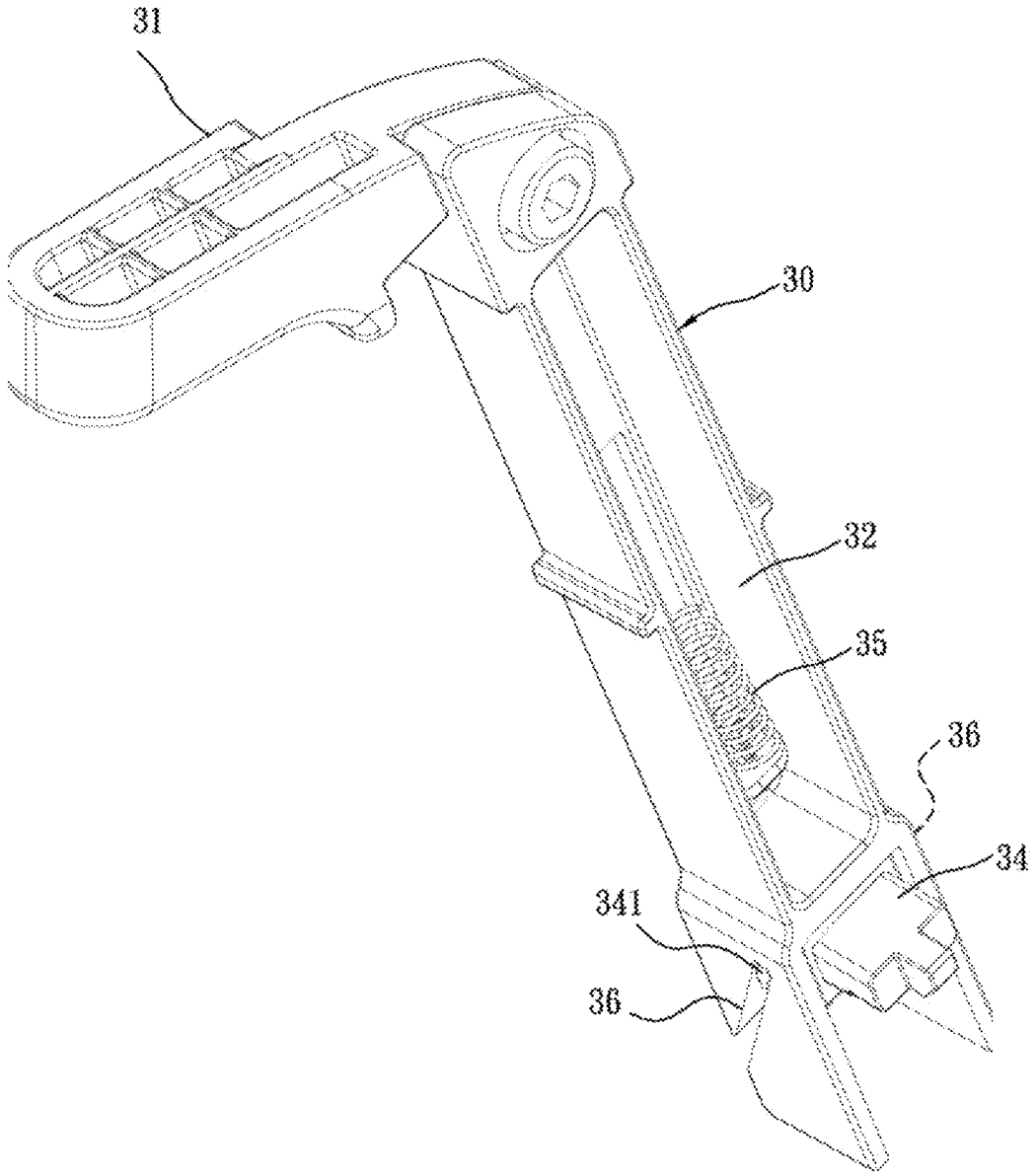
FIG. 8 is a perspective view of a rod of an embodiment according to the present invention.
Figure 17:
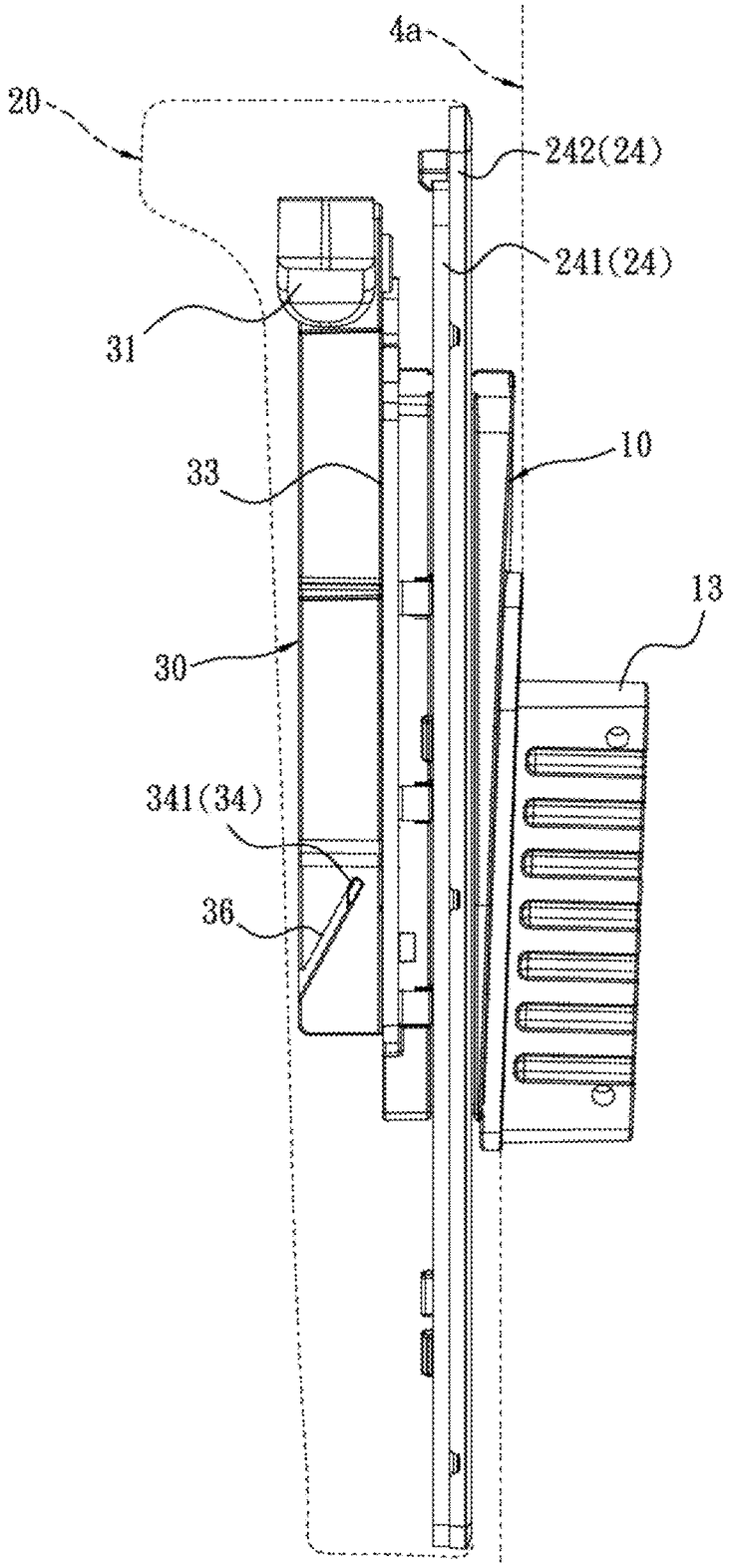
FIG. 17 is a schematic drawing of an embodiment inclined an angle according to the present invention.
Figure 18:
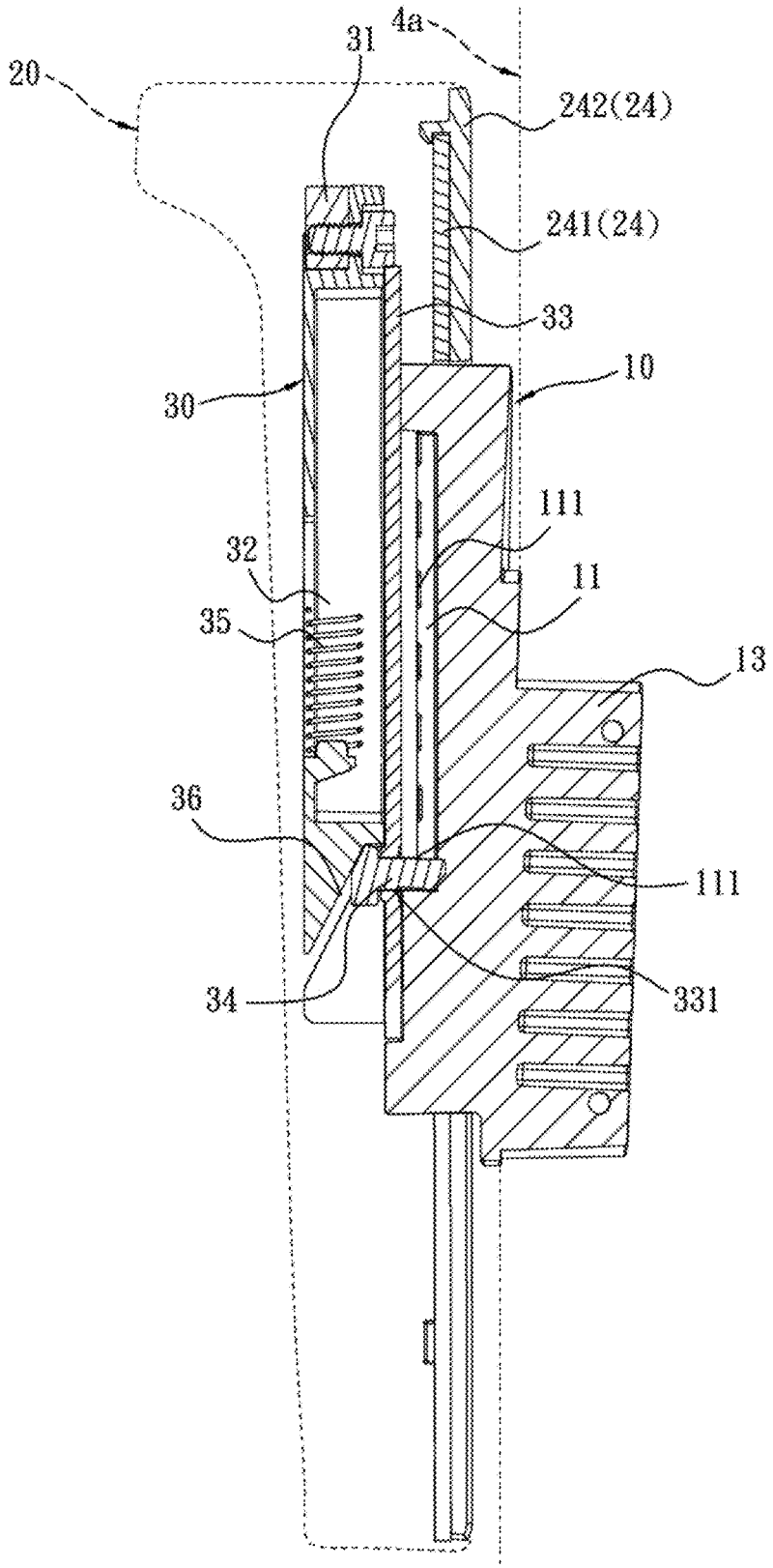
FIG. 18 is a schematic drawing showing a section of the embodiment in FIG. 17 according to the present invention.
Figure 21:
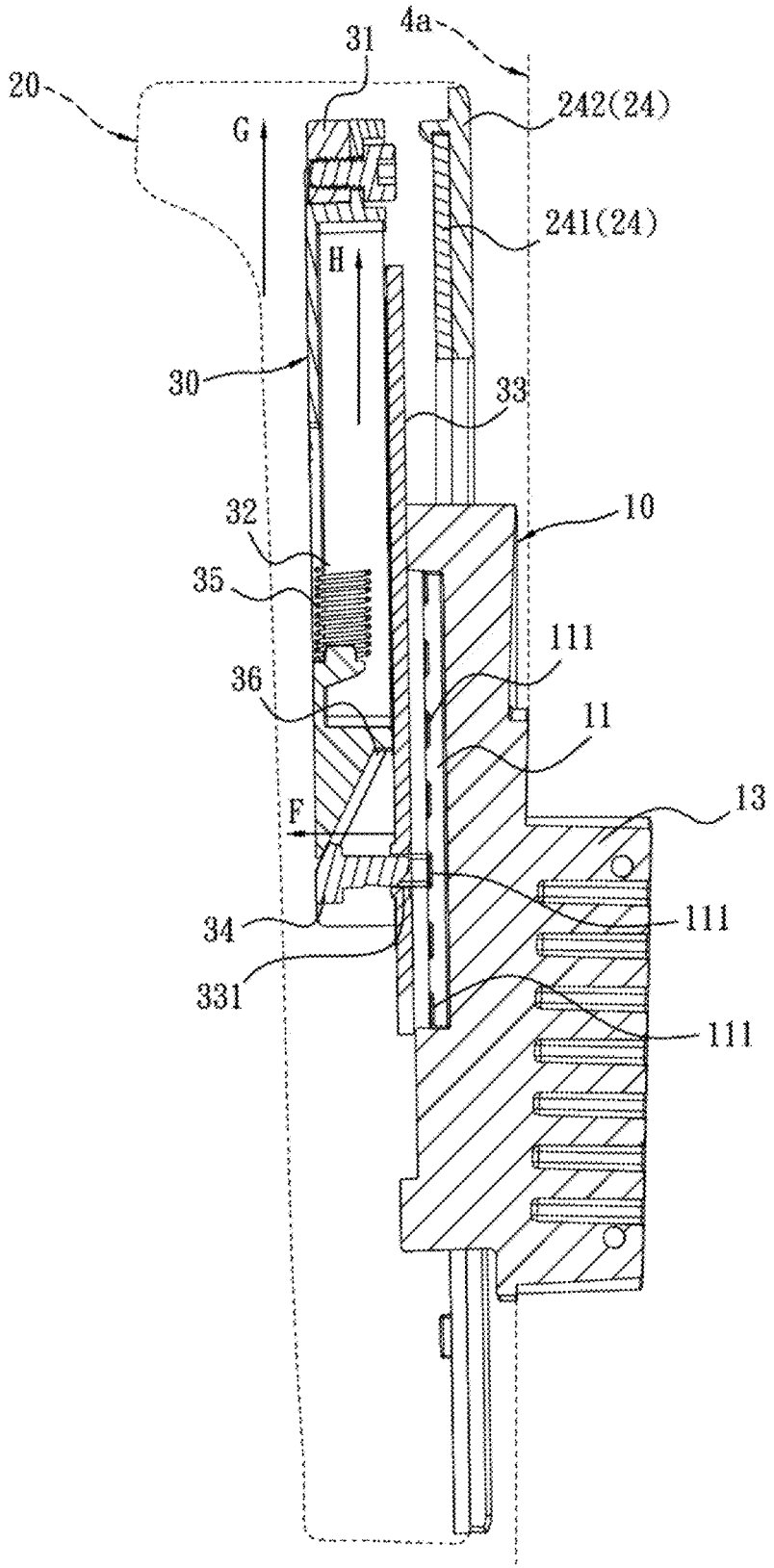
FIG. 21 is a schematic drawing showing a section of the embodiment in FIG. 20 according to the present invention.

As shown in FIG. 10-13, the rod 30 is mounted in the sliding base 23 of the outer sleeve 20 and able to be sliding vertically in the sliding base 23. Refer to FIG. 6-8, the rod 30 is composed of a drive portion 31, an elastic member seat 32, a pad 33, a snap block 34, an elastic member 35 and two inclined guiding slots 36. The drive portion 31 is extending from the top of the rod 30 and protruding from the operation window 22 of the outer sleeve 20 for allowing users to operate the height adjustment assembly 1, as shown in FIG. 10, FIG. 11, FIG. 19 and FIG. 22. The drive portion 31 is detachably mounted to the rod 30 for easy assembly and fast production, as shown in FIG. 9. The elastic member seat 32 is provided with a lower spring assembly portion 321 aligned with the upper spring assembly portion 231, as shown in FIG. 6, FIG. 9, and FIG. 11. The pad 33 is used for covering the elastic member seat 32 and located between the sliding base 23 and the slot portion 11, as shown in FIG. 18 and FIG. 21. Refer to FIG. 6, FIG. 7, and FIG. 8, two sliding wings 341 are projecting from the left side and the right side of the snap block 34 respectively. Refer to FIG. 7, FIG. 8, and FIG. 17, the elastic member 35 is a spring while the two inclined guiding slots 36 are arranged at two opposite sides of a lower end of the rod 30 and corresponding to each other. The inclined guiding slot 36 is extending outward and downward obliquely. As shown in FIG. 18, FIG. 19, and FIG. 21-24, the snap block 34 can be mounted and locked into one of the slots 111 of the slot portion 11 of the fixing base 10 by elasticity of the elastic member 35 of the rod 30. Thereby the mounting seat 21 of the outer sleeve 20 is positioned at a certain height corresponding to the slot 111 in which the snap block 34 is locked.

Figure 22:
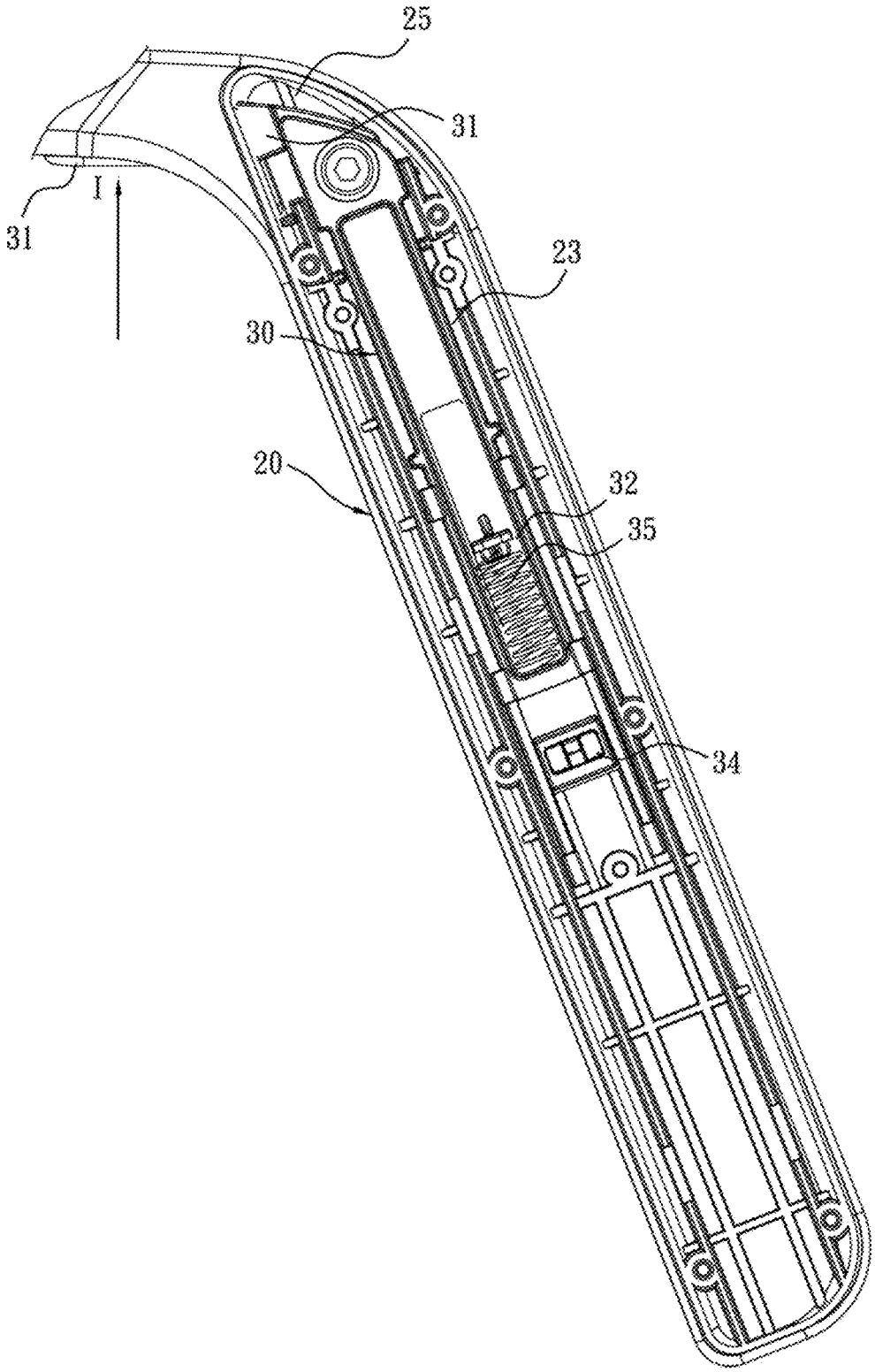
FIG. 22 is a schematic drawing showing the embodiment in FIG. 19 in which a rod is driven according to the present invention.

As shown in FIG. 10, FIG. 11, and FIG. 20-22, while users press the drive portion 31 (as the arrow E in FIG. 20, the arrow H in FIG. 21 and the arrow I in FIG. 22 indicate) and the snap block 34 of the rod 30 is synchronously driven to move for adjustment (as the arrow F in FIG. 21 indicates), the drive portion 31 is moved into the sliding space 25, as shown in FIG. 22.

Figure 20:
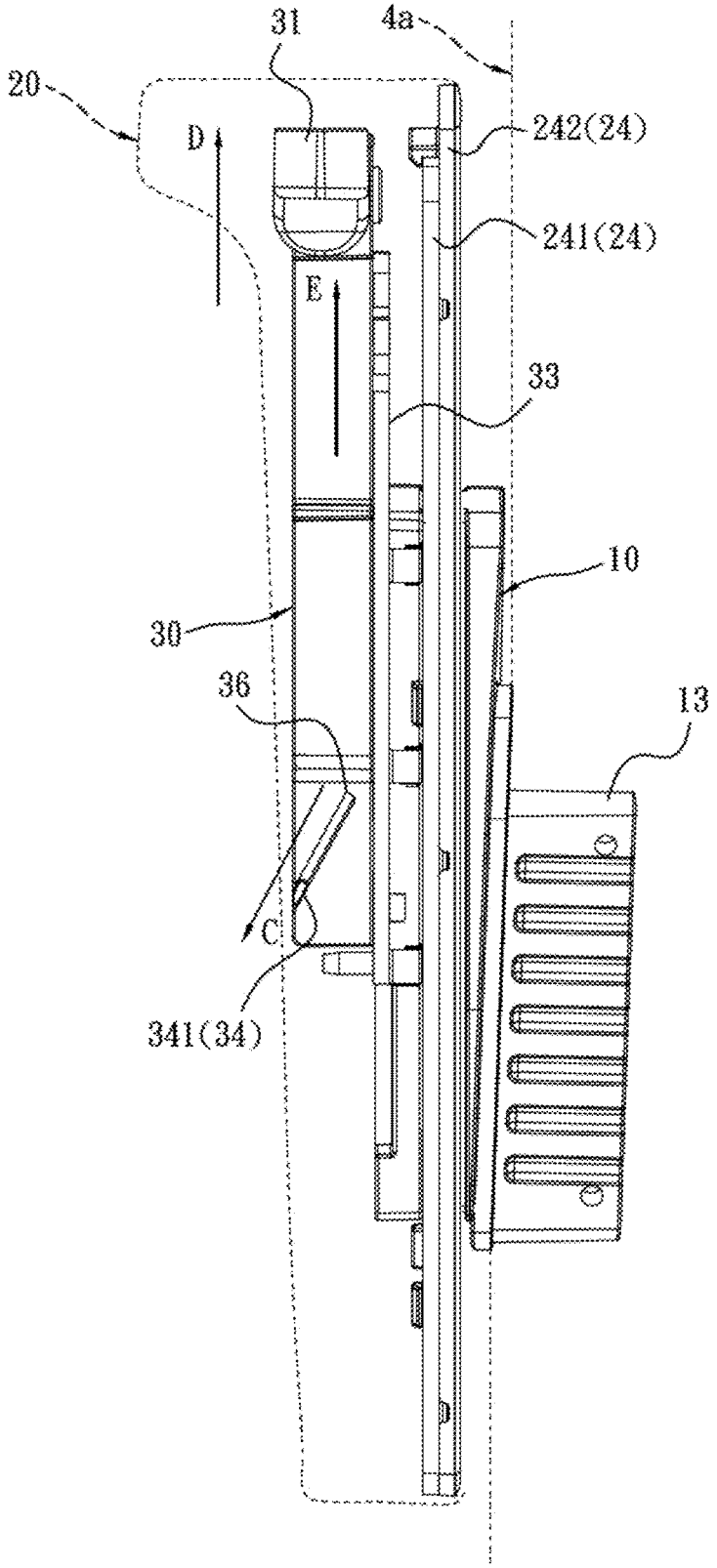
FIG. 20 is a schematic drawing showing the embodiment in FIG. 17 in which an outer sleeve is sliding upward according to the present invention.

Refer to FIG. 17, FIG. 18, FIG. 20 and FIG. 21, the two sliding wings 341 are limited within and moved along the two inclined guiding slots 36 of the rod 30, as the arrow C in FIG. 20 indicates. Thereby the vertical movement of the rod 30 can be converted into the horizontal movement of the snap block 34, as the arrow F in FIG. 21 indicates.

Refer to FIG. 20 and FIG. 21, the pad 33 is provided with a guiding hole 331 through which the snap block 34 is inserted. When the vertical movement of the rod 30 (as the arrow E in FIG. 20 and the arrow H in FIG. 21 indicate) is converted into the horizontal movement of the snap block 34 (as the arrow F in FIG. 21 indicates), the snap block 34 is limited in the guiding hole 331 and moved horizontally, as shown in FIG. 21. Thereby the snap block 34 is mounted into the respective slots 111 stably and accurately.

Refer to FIG. 10 and FIG. 11, the elastic member 35 is arranged between the upper spring assembly portion 231 and the lower spring assembly portion 321.

When the user drives the drive portion 31 in order to synchronously drive the snap block 34 of the rod 30 to move for adjustment (as the arrow E in FIG. 20, the arrow H in FIG. 21 and the arrow I in FIG. 22 indicate), the snap block 34 is released from one of the slots 111 of the slot portion 11 of the fixing base 10 to be in a released state, as shown in FIG. 20-22. Now the fixing base 10 remains still while the outer sleeve 20 and the rod 30 can be moved and adjusted vertically relative to the fixing base 10, as the arrow D in FIG. 20 and the arrow G in FIG. 21 indicate.

Figure 19:
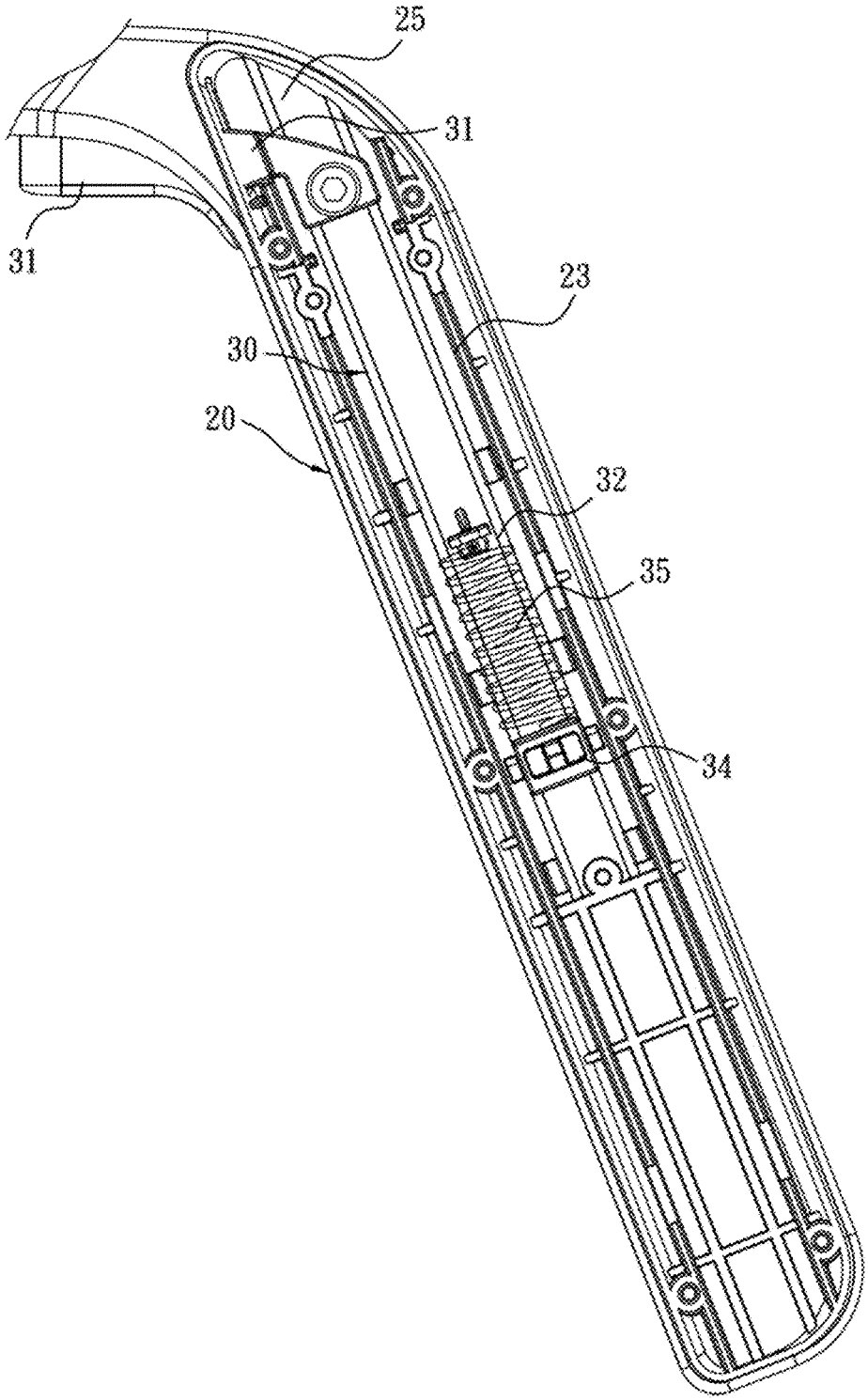
FIG. 19 is a schematic drawing showing a partial side view of the embodiment in FIG. 10 according to the present invention.

After vertical movement and adjustment of the outer sleeve 20 and the rod 30, the user releases the drive portion 31. Then the snap block 34 is mounted and locked into another one of the slots 111 of the slot portion 11 of the fixing base 10 by elasticity of the elastic member 35, back to a fastened state, as shown in FIG. 18 and FIG. 19.

Figure 23:
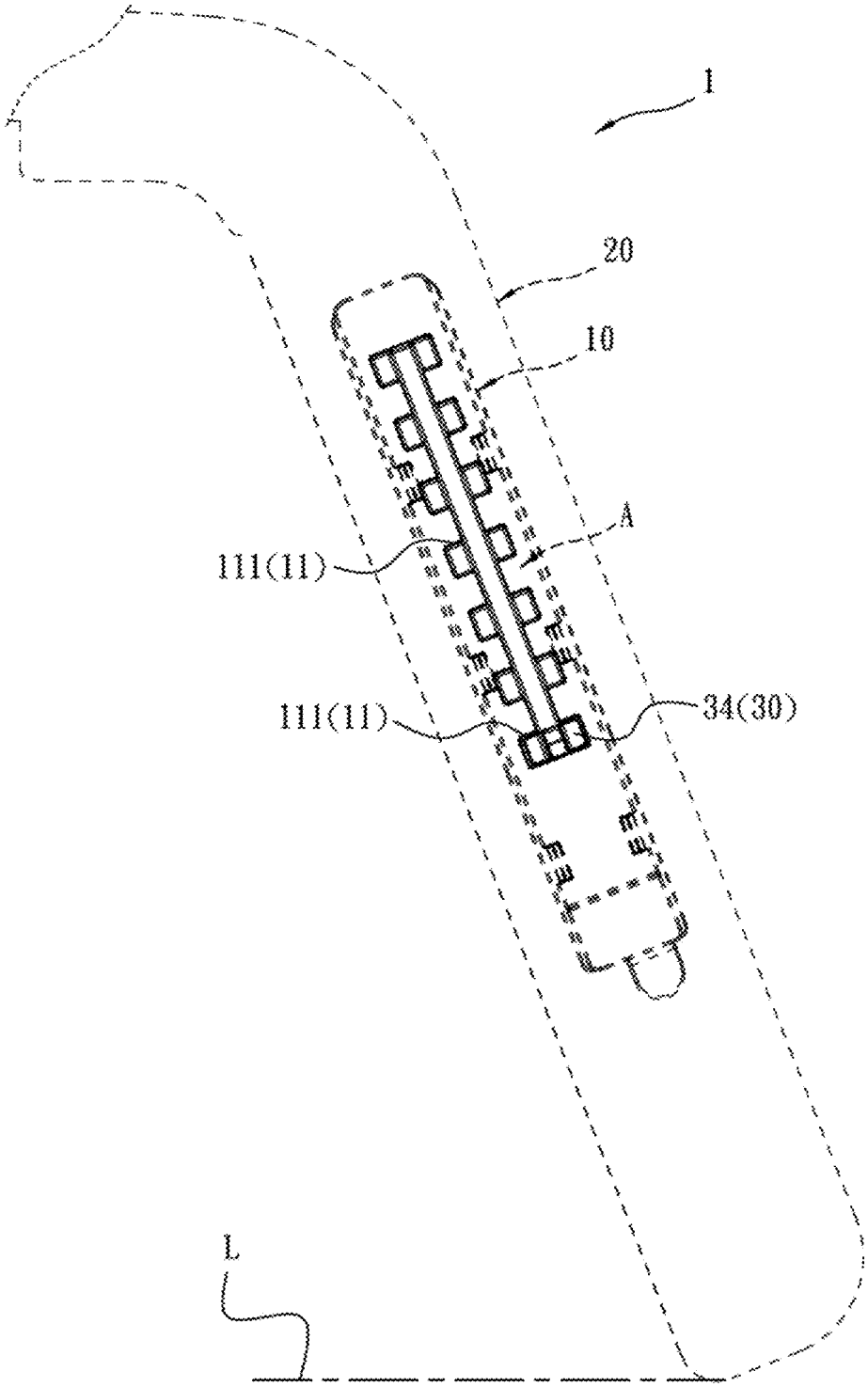
FIG. 23 is a schematic drawing showing a side view of an embodiment in which an outer sleeve is moved to the lowest point of its movement according to the present invention.
Figure 24:
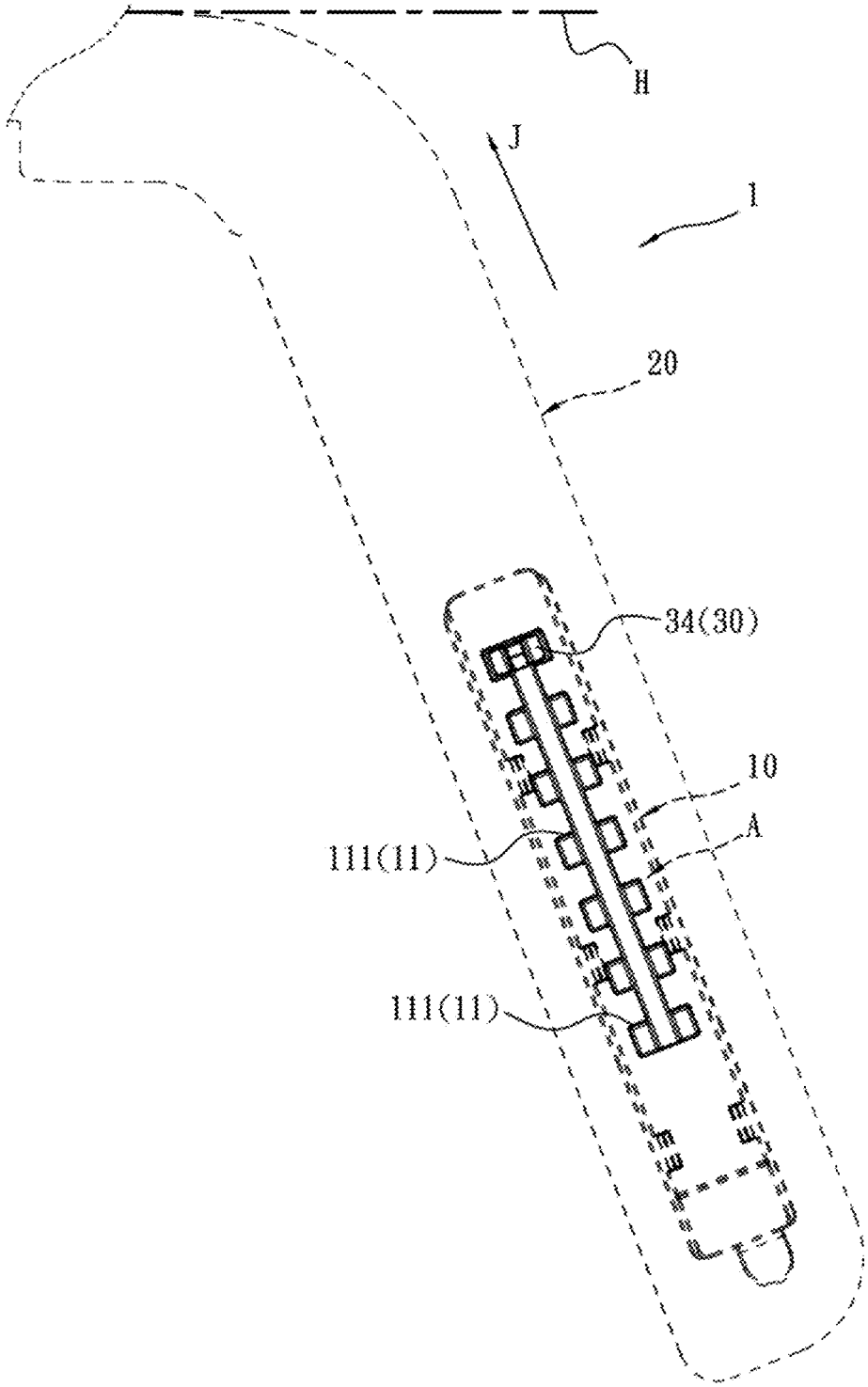
FIG. 24 is a schematic drawing showing a side view of an embodiment in which an outer sleeve is moved to the highest point of its movement according to the present invention.

Refer to FIG. 4, FIG. 5, FIG. 23 and FIG. 24, when the outer sleeve 20 is moved and adjusted vertically relative to the fixing base 10, as the arrow K in FIG. 5 and the arrow J in FIG. 24 indicate, the vertical movement of the outer sleeve 20 includes a highest point H (as shown in FIG. 24) and a lowest point L (as shown in FIG. 23). At the moment, the fixing base 10 or the fixed position A (as shown in FIG. 4 and FIG. 5) is located within the height range from the highest point H to the lowest point L of the movement of the outer sleeve 20, as shown in FIG. 23 and FIG. 24.

Compared with techniques available now, the present invention has the following advantages:

(1) When the outer sleeve 20 of the present invention is moved and adjusted vertically relative to the fixing base 10 (as the arrow J in FIG. 24 indicate), the fixing base 10 or the fixed position A (as shown in FIG. 4 and FIG. 5) is located within the height range from the highest point H to the lowest point L of the movement of the outer sleeve 20, as shown in FIG. 23 and FIG. 24. No matter viewed from the left side or right side of the chair 4, the fixing base 10 of the height adjustment assembly 1 will not be exposed. Thus the fixing base 10 is covered with the outer sleeve 20 to enhance the aesthetics and the value of the furniture and further improve the competitiveness of the furniture in the market.

Figure 25:
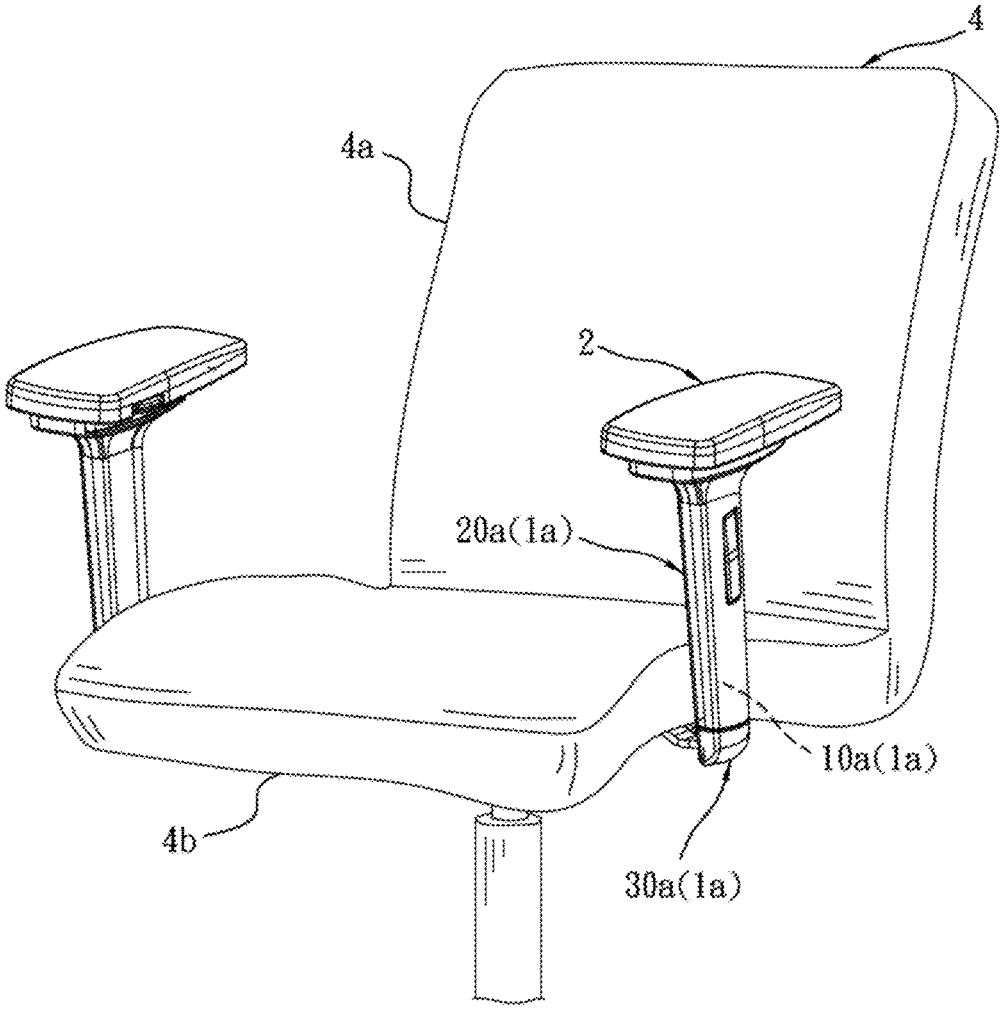
FIG. 25 is a perspective view of a prior art.

(2) The prevent height adjustment assembly 1 can be fixed on the chair 4 and moved vertically for adjustment by one-segmented structure (the fixing base 10). The two-segmented structure composed of a sliding base **10*a* and a fixing member 30***a* available now is no more required (as shown in FIG. 25). The one-segmented design is beneficial to reduce the cost at the manufacturer end.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

The invention claimed is:

1. A height adjustment assembly connected to one side of furniture for use in the furniture comprising:

a fixing base including a rail portion, a fixing portion, and a slot portion which is provided with a plurality of slots spaced apart, arranged vertically and communicating with one another; the fixing portion used for being mounted to and fixed on a fixed position on the side of the furniture;

an outer sleeve which is connected to the fixing base, located outside the fixing base, and configured to slide vertically along the rail portion; the outer sleeve including a mounting seat disposed on top of the outer sleeve, an operation window arranged at one side of the outer sleeve and communicating with an inner space of the outer sleeve, and a sliding base mounted in the inner space of the outer sleeve;

a rod which is mounted in the sliding base of the outer sleeve, configured to slide vertically in the sliding base of the outer sleeve and having a drive portion, an elastic member seat and a snap block; the drive portion extending from top of the rod and protruding from the operation window of the outer sleeve for allowing users to operate the height adjustment assembly; the elastic member seat provided with an elastic member; wherein the snap block is mounted and locked in one of the slots of the slot portion of the fixing base by elasticity of the elastic member of the rod so that the mounting seat of the outer sleeve is positioned at a certain height corresponding to the slot in which the snap block is mounted and locked;

wherein the snap block is released from the one of the slots of the slot portion of the fixing base to be in a released state when the drive portion is driven for driving the snap block of the rod to move for adjustment; wherein the fixing base remains still while the outer sleeve and the rod are able to be moved and adjusted vertically relative to the fixing base; wherein after the outer sleeve and the rod being moved and adjusted vertically relative to the fixing base, the drive portion is released so that the snap block is mounted and locked into another one of the slots of the slot portion of the fixing base and turned back to a fastened state by elasticity of the elastic member;

wherein a vertical movement of the outer sleeve includes a highest point and a lowest point when the outer sleeve is moved and adjusted vertically relative to the fixing base; the fixing base or a position where the fixing base is fixed is located between the highest point and the lowest point of the movement of the outer sleeve.

2. The height adjustment assembly as claimed in claim 1, wherein two inclined guiding slots are arranged at two opposite sides of a lower end of the rod and corresponding to each other; wherein each inclined guiding slot extends outward and downward obliquely; wherein two sliding wings are projecting from a left side and a right side of the snap block respectively; the two sliding wings are limited within and moved along the two inclined guiding slots of the rod correspondingly; thereby the vertical movement of the rod is able to be converted into horizontal movement of the snap block.

3. The height adjustment assembly as claimed in claim 2, wherein the rod is further provided with a pad which is used for covering the elastic member seat and located between the sliding base and the slot portion; the pad includes a guiding hole through which the snap block is inserted; the snap block is limited in the guiding hole and moved horizontally when the vertical movement of the rod is converted into the horizontal movement of the snap block.

4. The height adjustment assembly as claimed in claim 1, wherein the elastic member is a spring; wherein the sliding base is provided with an upper spring assembly portion and the elastic member seat is provided with a lower spring assembly portion which is aligned with the upper spring assembly portion; wherein the elastic member is arranged between the upper spring assembly portion and the lower spring assembly portion.

5. The height adjustment assembly as claimed in claim 1, wherein the outer sleeve further includes a cover member which is disposed on one side of the outer sleeve for covering the rod and the cover member is one part formed by a first cover plate and a second cover plate secured with each other firmly; the first cover plate is covering the rod and provided with a first long slot with an opening facing downward while the second cover plate is arranged over the first cover plate and having a second long slot with an opening facing downward; the first long slot and the second long slot are aligned with each other; wherein the first long slot and the second long slot of the cover member are connected to the rail portion and able to slide vertically along the rail portion.

6. The height adjustment assembly as claimed in claim 1, wherein the drive portion is located on top of the rod; wherein the inner space of the top of the outer sleeve includes a sliding space which is located adjacent to the operation window; wherein the drive portion is moved into the sliding space when the drive portion is driven for driving the snap block of the rod to move for adjustment.

7. The height adjustment assembly as claimed in claim 1, wherein a plurality of anti-vibration members are disposed on an outer edge of the fixing base for abutting against both the fixing base and the sliding base.

8. The height adjustment assembly as claimed in claim 1, wherein the drive portion of the rod is detachably mounted to the rod.

9. The height adjustment assembly as claimed in claim 1, wherein the fixing portion of the fixing base is a long and narrow locking block; wherein the furniture is a chair which includes a seat back and a seat; wherein the height adjustment assembly is further connected to one side of the seat back of the chair by the fixing portion being inclined at angle.

10. The height adjustment assembly as claimed in claim 1, wherein the mounting seat of the outer sleeve is used for connection to an armrest or a tablet.

* * * * *